US007336796B2

(12) United States Patent
Blumenau

(10) Patent No.: US 7,336,796 B2
(45) **Date of Patent: *Feb. 26, 2008**

(54) HEARING ASSISTIVE APPARATUS HAVING SOUND REPLAY CAPABILITY AND SPATIALLY SEPARATED COMPONENTS

(76) Inventor: Trevor I. Blumenau, 1800 Pacific Ave., #505, San Francisco, CA (US) 94109

( * ) Notice: Subject to any disclaimer, the term of this patent is extended or adjusted under 35 U.S.C. 154(b) by 10 days.

This patent is subject to a terminal disclaimer.

(21) Appl. No.: 10/400,748

(22) Filed: Mar. 26, 2003

(65) Prior Publication Data

US 2003/0223607 A1 Dec. 4, 2003

(51) Int. Cl.
*H04R 25/00* (2006.01)

(52) U.S. Cl. ..... 381/315; 381/312

(58) Field of Classification Search ..... 381/23.1, 381/312, 314, 315–318, 320, 321, 323, 328, 381/330, 381, 60, 313; 704/200, 205–208, 704/271, 500, 503

See application file for complete search history.

(56) References Cited

U.S. PATENT DOCUMENTS

| | | | | | |
|---|---|---|---|---|---|
| 2,764,640 | A * | 9/1956 | Osserman et al. | ..... | 381/323 |
| 3,999,015 | A | 12/1976 | Snyder et al. | ..... | 179/1 |
| 4,130,729 | A | 12/1978 | Gagnon | ..... | 179/1 |
| 4,212,119 | A | 7/1980 | Tomatis | ..... | 35/35 |
| 4,918,736 | A | 4/1990 | Bordewijk | ..... | 381/68 |
| 5,091,952 | A * | 2/1992 | Williamson et al. | ..... | 381/318 |
| 5,202,927 | A | 4/1993 | Topholm | ..... | 391/68 |
| 5,343,532 | A * | 8/1994 | Shugart, III | ..... | 381/315 |
| 5,710,819 | A | 1/1998 | Topholm et al. | ..... | 381/68.2 |
| 5,717,818 | A * | 2/1998 | Nejime et al. | ..... | 381/312 |
| 5,721,783 | A | 2/1998 | Anderson | ..... | 381/68.6 |
| 5,867,581 | A | 2/1999 | Obara | ..... | 381/312 |
| 5,903,227 | A | 5/1999 | Scheuer | ..... | 340/945 |
| 6,021,207 | A * | 2/2000 | Puthuff et al. | ..... | 381/330 |
| 6,160,496 | A | 12/2000 | Scheuer | ..... | 340/945 |
| 6,226,605 | B1 * | 5/2001 | Nejime et al. | ..... | 704/207 |
| 6,236,731 | B1 | 5/2001 | Brennan et al. | ..... | 381/316 |
| 6,307,945 | B1 * | 10/2001 | Hall | ..... | 381/315 |
| 6,493,450 | B1 | 12/2002 | Scheuer et al. | ..... | 381/57 |
| 6,694,034 | B2 * | 2/2004 | Julstrom et al. | ..... | 381/315 |
| 6,816,600 | B1 * | 11/2004 | Jakob et al. | ..... | 381/315 |
| 2003/0045283 | A1 * | 3/2003 | Hagedoorn | ..... | 455/426 |

FOREIGN PATENT DOCUMENTS

| | | |
|---|---|---|
| JP | 05-056499 | 3/1993 |

OTHER PUBLICATIONS

IEEE Standard 802.15.1-2002, Jun. 14, 2002, p. 19.*

(Continued)

*Primary Examiner*—Suhan Ni
(74) *Attorney, Agent, or Firm*—David R. Graham

(57) ABSTRACT

Hearing assistive apparatus can be implemented to include sound replay capability, the hearing assistive apparatus enabling operation in a replay mode (in which the hearing assistive apparatus replays sound that occurred prior to the current time), as well as in a current sound mode (in which the hearing assistive apparatus reproduces—and, typically, enhances—sound as the sound occurs) and/or an off mode (in which the hearing assistive apparatus does not produce sound). The hearing assistive apparatus can also, additionally or alternatively, be implemented so that part of the hearing assistive apparatus is spatially separated from another part of the hearing assistive apparatus (in particular, so that part of the hearing assistive apparatus is spatially separated from part of the hearing assistive apparatus that is ear-mounted).

39 Claims, 8 Drawing Sheets

OTHER PUBLICATIONS

PMA7000B-Series Audio Selector Panel Marker Beacon Receiver and Stereo Intercom System—Pilot's Guide and Operation Manual, PS Engineering, Inc., May 2002.

World Wide Web page describing "Car Cell Phone System with Continuous Digital Recording Hear It Again Technology," www.sharperimage.com/us/en/catalog, Nov. 8, 2001.

World Wide Web page describing "Desktp Hear it Again Continuous Digital Recorder for Telephones," www.sharperimage.com/us/en/catalog, Nov. 8, 2001.

The Sharper Image—Holiday 2001 Catalog, pp. 10 and 11.

* cited by examiner

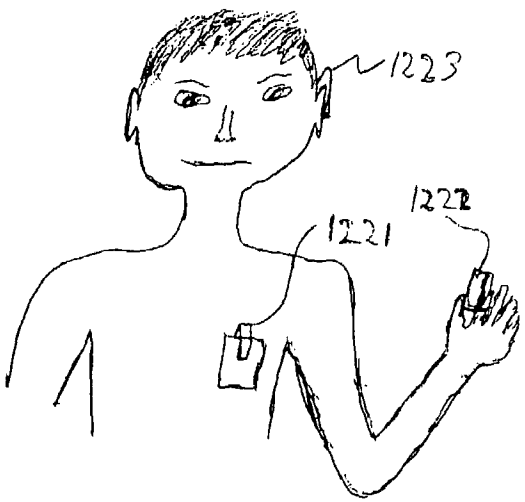
FIG. 12A
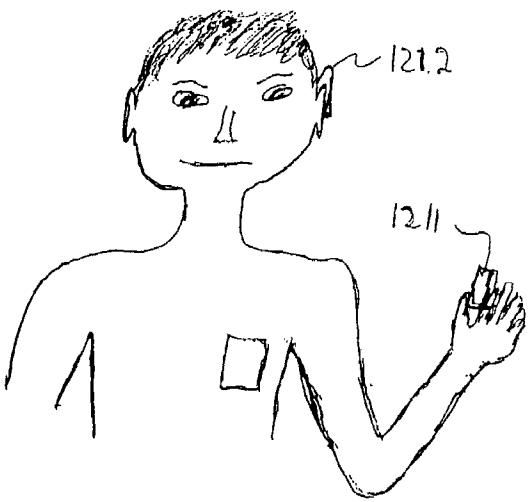
FIG. 12B
FIG. 12C

HEARING ASSISTIVE APPARATUS HAVING SOUND REPLAY CAPABILITY AND SPATIALLY SEPARATED COMPONENTS

BACKGROUND OF THE INVENTION

1. Field of the Invention

This invention relates to apparatus for assisting hearing and, in particular, to apparatus for assisting hearing that includes sound replay capability, as well as to method(s) and computer program(s) for implementing and using such apparatus.

2. Related Art

FIG. 1 is a block diagram of a conventional analog hearing aid 100. The hearing aid 100 is mounted on a wearer on, in, or proximate to an ear of the wearer to assist the wearer in hearing. The hearing aid 100 includes a microphone 101 that is adapted to sense sound in the vicinity of the hearing aid 100 (and, thus, in the vicinity of the wearer) and convert the sensed sound to electrical signals. (The hearing aid 100 could also be implemented to include a receiver instead of, or in addition to, the microphone 101, signal(s) representing sensed sound being transmitted to the receiver by one or more transmitter(s) that are typically positioned at location(s) that are not proximate to an ear of the wearer of the hearing aid 100.) The electrical signals produced by the microphone 101 (and/or received by a receiver) are input to a filter 102 which processes the electrical signals to remove undesirable artifacts. The filtered electrical signals from the filter 102 are input to an amplifier 103 which amplifies the electrical signals to produce an amplified electrical signal that is compatible (as understood by those skilled in the art) with the speaker 105 (described later). The amplified electrical signals from the amplifier 103 are input to a filter 104 which processes the amplified electrical signals to further remove undesirable artifacts. A speaker 105 receives the electrical signals from the filter 104 and produces sound in accordance with the electrical signals, thereby reproducing sound that occurs in the vicinity of the wearer. In particular, as is well understood, the hearing aid 100 reproduces sound that occurs in the vicinity of a wearer so as to facilitate hearing of that sound by the wearer. (Though the filter 102 and the filter 104 are described above as part of the hearing aid 100, those skilled in the art will understand that a conventional analog hearing aid, such as the hearing aid 100, need not necessarily include a filter such as the filter 102 and/or a filter such as the filter 104. Additionally, those skilled in the art will understand that, though the filters 102 and 104 are illustrated in FIG. 1 separate from other components of the hearing aid 100, the filter 102 can be implemented in the same apparatus as the microphone 101 (and/or receiver) or the amplifier 103, and/or the filter 104 can be implemented in the same apparatus as the amplifier 103 or the speaker 105.)

FIG. 2 is a block diagram of a conventional digital hearing aid 200. As the hearing aid 100 of FIG. 1, the hearing aid 200 is worn by a wearer to assist the wearer in hearing. The hearing aid 200 includes a microphone 201 (and/or receiver), filters 202 and 204, and a speaker 205 which provide the same or similar functionality as that described above for the microphone 101 (and/or receiver), filters 102 and 104, and speaker 105, respectively, of the hearing aid 100. (Like a conventional analog hearing aid, a conventional digital hearing aid, such as the hearing aid 200, need not necessarily include the filter 202 and/or the filter 204.) In the digital hearing aid 200, the filtered electrical signals from the filter 202 are input to an A/D converter 206 to convert the analog electrical signals produced by the microphone 201 (and/or received by a receiver) and processed by the filter 202) to digital electrical signals. The digital electrical signals from the A/D converter 206 are input to a digital processing unit 203 which processes the electrical signals, as described further below, to produce a processed electrical signal having desired characteristics and compatibility with the speaker 205. The processed electrical signals from the digital processing unit 203 are input to a D/A converter 207 to convert the digital electrical signals to analog electrical signals that can be used by the speaker 205 to produce sound. (Though not illustrated in FIG. 2, the hearing aid 200 may also include an amplifier between the D/A converter 207 and the speaker 205 to amplify the electrical signals to have a magnitude compatible with the speaker 205, as understood by those skilled in the art.)

As indicated above, the digital processing unit 203 of the hearing aid 200 processes the electrical signals. In particular, the digital processing unit 203 can be implemented to selectively process the electrical signals based on the magnitude of the electrical signals and/or the frequencies contained in the electrical signals. The digital processing unit 203 can include a digital signal processor (DSP), as known to those skilled in the art, which can be implemented to accomplish the above-described functionality of the digital processing unit 203. The digital processing unit 203 can also include other devices (e.g., a memory device) in addition to the DSP to facilitate the operations of the DSP.

Conventional hearing aids have been produced in a variety of sizes and shapes, but, as can readily be appreciated, all hearing aids must be, or preferably are, constructed to be relatively small apparatus. Until recently, manufacturing capabilities have limited the ability to include functionality in a hearing aid in addition to that described above without causing the hearing aid to be larger than is desirable for some applications and/or people. In the same vein, the small size of hearing aids necessitates the use of a relatively small power supply (e.g., battery), which has also limited the ability to include functionality in a hearing aid in addition to that described above.

Typically, all parts of a hearing aid are implemented in apparatus mounted on, in, or proximate to an ear of the wearer. A previous hearing aid has been implemented so that a remote control on a watch enables a wearer of the hearing aid to change the acoustical mode of the hearing aid, e.g., change filtering characteristics of the hearing aid. As discussed further below, it can be desirable to implement a hearing aid so that one or more parts of the hearing aid providing other functionality are implemented in apparatus that is spatially separated (i.e., remote) from hearing aid apparatus mounted on, in, or proximate to an ear of the wearer.

SUMMARY OF THE INVENTION

In accordance with one aspect of the invention, hearing assistive apparatus includes sound replay capability. Hearing assistive apparatus according to the invention can be implemented to enable operation in a replay mode (in which the hearing assistive apparatus replays sound that occurred prior to the current time, e.g., sound that occurred a specified duration of time, such as 5, 10 or 30 seconds, prior to the current time), as well as operation in an off mode (in which production of sound by the hearing assistive apparatus is inhibited) and/or a current sound mode (in which the hearing assistive apparatus reproduces—and, typically, enhances—sound as the sound occurs). In accordance with another aspect of the invention, hearing assistive apparatus can be implemented so that part of the hearing assistive apparatus is spatially separated from another part of the hearing assistive apparatus. In particular, hearing assistive apparatus according to the invention can be implemented so that part of the hearing assistive apparatus (e.g., user input apparatus, sound replay apparatus and/or sound data acquisition apparatus) is spatially separated from part of the hearing assistive apparatus (e.g., sound production apparatus) that is ear mounted. The invention can be implemented in both analog and digital hearing assistive apparatus.

In one embodiment of the invention, a hearing assistive device includes: 1) sound data acquisition apparatus; 2) sound production apparatus adapted to be mounted on, in, or proximate to an ear of a wearer of the hearing assistive device; and 3) sound replay apparatus that enables operation of the hearing assistive device in a replay mode in which a sound replay is produced. In a particular embodiment, the sound replay apparatus also enables operation of the hearing assistive device in an off mode in which the production of sound by the hearing assistive device is inhibited. In an even more particular embodiment of the immediately previous particular embodiment, the sound replay apparatus also enables operation of the hearing assistive device in a current sound mode in which sound is reproduced (and, typically, enhanced) as the sound occurs. In another particular embodiment, the hearing assistive device includes communication apparatus that enables communication of sound data between the sound production apparatus and a part of the sound data acquisition apparatus and/or the sound replay apparatus that is spatially separated from the sound production apparatus. In yet another particular embodiment, the hearing assistive device includes user input apparatus that is spatially separated from the sound production apparatus, and communication apparatus that enables communication between spatially separated parts of the hearing assistive device.

The sound data acquisition apparatus can sense sound in the vicinity of the hearing assistive device and convert the sensed sound to a signal representing current sound data (e.g., sound data acquisition apparatus can be implemented using a microphone), and/or the sound data acquisition apparatus can receive a signal representing current sound data that is transmitted by a transmitter (which can be positioned at a location that is not proximate to a user of the hearing assistive device). The sound production apparatus is adapted to produce sound in accordance with sound data acquired by the sound data acquisition apparatus and can be implemented using, for example, a speaker. The sound replay apparatus is adapted to enable replay of sound represented by sound data acquired by the sound data acquisition apparatus. The sound replay apparatus includes a sound data accumulation device for accumulating replay sound data representing sound occurring during a replay time (e.g., a specified duration of time, such as about 5 seconds, immediately preceding the current time), and a sound data selection device for controlling whether, and, if so, which, sound data is transmitted to the sound production apparatus for use in producing sound, thereby selecting the mode of operation of the hearing assistive device. The sound replay apparatus can be implemented, for example, in an integrated circuit.

The sound data accumulation device of the sound replay apparatus can be implemented using a multiplicity of sets of an amplifier, a first switch, a capacitor and a second switch arranged in series in that order, and a mechanism for controlling the first and second switches of each set. The first switches and the second switches are alternately opened and closed, 180 degrees out of phase with respect to each other, at a specified frequency. The first and second switches can be implemented using N-channel and P-channel transistors, respectively. Such a sound data accumulation device can be implemented to provide a single control signal to all of the first and second switches to effect operation of the switches. The specified frequency can be, for example, greater than or equal to about 8 kHz, or greater than or equal to about 40 kHz (the frequency used can depend on a desired fidelity of the hearing assistive device).

The sound data accumulation device of the sound replay apparatus can also be implemented using a random access memory, current sound data being input to the random access memory as the current sound data is acquired, replay sound data being output from the random access memory as current sound data is being input to the random access memory if the input of the current sound data would cause the amount of sound data stored in the random access memory to exceed a replay time.

The sound replay apparatus of a hearing assistive device according to the invention can further include a second sound data selection device. The second sound data selection devices selects either the current sound data or the replay sound data to be transmitted to the sound data accumulation device for accumulation by the sound data accumulation device. The first and second sound data selection devices can be operated synchronously such that when replay sound data is transmitted to the sound production apparatus, replay sound data is also transmitted to the sound data accumulation device, thus enabling the replay sound data existing at the time of beginning operation of the hearing assistive device in replay mode to be successively replayed more than one time.

A hearing assistive device according to the invention can include user input apparatus for enabling control of the operation of the hearing assistive device. The user input apparatus can include, for example, one or any combination of the following: 1) a mode selection device for enabling a user of the hearing assistive device to specify a mode of operation of the hearing assistive device; 2) a replay duration specification device for enabling a user of the hearing assistive device to specify a replay time; 3) apparatus for enabling a user of the hearing assistive device to control the volume of the sound replay; 4) apparatus for enabling a user of the hearing assistive device to control the speed of the sound replay; and 5) apparatus for enabling a user of the hearing assistive device to effect particular filtering of the sound data used to produce the sound replay. A user input apparatus of a hearing assistive device according to the invention can also be implemented to enable other types of user control of the sound replay, such as fast-forward, pause and rewind.

A hearing assistive device according to the invention can be implemented so that part of the hearing assistive device is spatially separated from another part of the hearing assistive device. In particular, a hearing assistive device according to the invention can be implemented so that part of the hearing assistive apparatus is spatially separated from part of the hearing assistive apparatus that is ear mounted. Communication among spatially separated parts of a hearing assistive device according to the invention can be implemented using wireless communication apparatus and protocols, or wired communication apparatus and protocols. For example, a hearing assistive device according to the invention can include user input apparatus that is spatially separated from the sound production apparatus of the hearing assistive device. A hearing assistive device according to the invention can also be implemented so that part or all of the sound replay apparatus and/or part of the sound data acquisition apparatus are spatially separated from the sound production apparatus. Further, each of the user input apparatus, sound replay apparatus and/or sound data acquisition apparatus can be implemented in separate apparatus or together in the same apparatus with other of the user input apparatus, sound replay apparatus and/or sound data acquisition apparatus. In various embodiments of the invention, parts of a hearing assistive device according to the invention that are spatially separated from the sound production apparatus can be implemented in, for example, apparatus that is adapted to be worn by a wearer of the hearing assistive device (e.g., a watch, lapel pin, necklace, jewelry), a hand-held device, or a device that can be carried in a pocket.

In another embodiment of the invention, a hearing assistive device can acquire current sound data, produce sound in accordance with sound data, accumulate replay sound data representing sound occurring during a replay time, and operate in a replay mode in which replay sound data is used in producing sound. In a particular embodiment, the hearing assistive device can also operate in an off mode in which sound data is inhibited from being used in producing sound. In another particular embodiment, the hearing assistive device can enable communication between sound production apparatus adapted to be mounted on, in, or proximate to an ear of a wearer of the hearing assistive device and a part of sound data acquisition apparatus and/or sound replay apparatus that is spatially separated from the sound production apparatus. In yet another particular embodiment, the hearing assistive device can enable communication between sound production apparatus adapted to be mounted on, in, or proximate to an ear of a wearer of the hearing assistive device and user input apparatus that is spatially separated from the sound production apparatus.

In yet another embodiment of the invention, a method includes the steps of: 1) acquiring current sound data; 2) producing sound in accordance with sound data; 3) accumulating replay sound data representing sound occurring during a replay time; and 4) controlling a hearing assistive device to operate in a replay mode in which replay sound data is used in producing sound. In a particular embodiment, the method also enables control of the hearing assistive device to operate in an off mode in which sound data is inhibited from being used in producing sound. In another particular embodiment, the method also includes the step of communicating between sound production apparatus adapted to be mounted on, in, or proximate to an ear of a wearer of the hearing assistive device and a part of sound data acquisition apparatus and/or sound replay apparatus that is spatially separated from the sound production apparatus. In yet another particular embodiment, the method also includes the step of communicating between sound production apparatus adapted to be mounted on, in, or proximate to an ear of a wearer of the hearing assistive device and user input apparatus that is spatially separated from the sound production apparatus.

In still another embodiment of the invention, a hearing assistive device includes: 1) sound data acquisition apparatus adapted to acquire current sound data representing sound that occurs in the vicinity of the hearing assistive device; 2) sound production apparatus adapted to produce sound in accordance with sound data acquired by the sound data acquisition apparatus; and 3) sound replay apparatus that enables operation of the hearing assistive device in a replay mode in which a sound replay is produced. During the time that the sound replay is being produced, the sound data acquisition apparatus can continue to acquire current sound data. The hearing assistive device can be implemented to also enable operation of the hearing assistive device in an off mode (in which the production of sound by the hearing assistive device is inhibited) and/or a current sound mode (in which the hearing assistive device immediately reproduces the sound, which can be enhanced, occurring in the vicinity of the hearing assistive device).

In yet another embodiment of the invention, audio display apparatus includes: 1) apparatus for producing a primary audio display and 2) hearing assistive apparatus in accordance with the invention. The hearing assistive apparatus includes: 1) sound data acquisition apparatus; 2) sound production apparatus; and 3) sound replay apparatus that enables operation of the hearing assistive device in a replay mode in which a sound replay is produced and an off mode in which the production of sound by the hearing assistive device is inhibited. The hearing assistive device can be implemented to also enable operation of the hearing assistive device in a current sound mode in which the hearing assistive device immediately reproduces the sound (which can be enhanced) occurring in the vicinity of the hearing assistive device. The apparatus for producing a primary audio display can be, for example, audio recording display apparatus or a radio.

BRIEF DESCRIPTION OF THE DRAWINGS

FIG. 12A illustrates a hearing assistive device in accordance with embodiments of the invention in which a part of the hearing assistive device is spatially sparated from ear-mounted hearing assistive apparatus of the hearing assistive device and is adapted to be worn by a wearer of the hearing assistive device.

FIG. 12B illustrates a hearing assistive device in accordance with embodiments of the invention in which a part of the hearing assistive device is spartially separated from ear-mounted hearing assistive apparatus of the hearing assistive device and is not adapted to be owrn by a wearer of the hearing assistive device.

FIG. 12C illustrates a hearing assistive device in accordance with embodiments of the invention in which parts of the hearing assistive device are spatially separated from ear-mounted hearing assitive apparatus of the hearing assisitve device and each other, one of the parts adapted to be worn by a wearer of the hearing assistive device and another of the parts not adapted to be worn by a weare of the hearing assitive device.

DETAILED DESCRIPTION OF THE INVENTION

Figure 1:
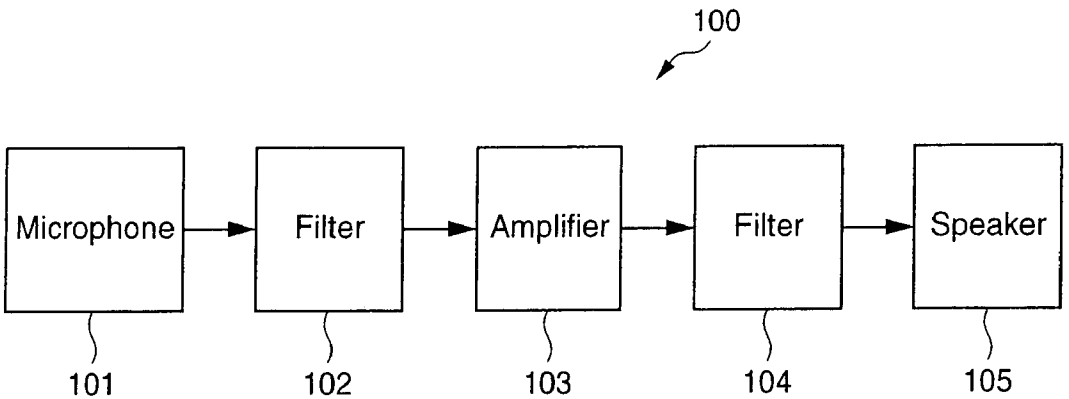
FIG. 1 (Prior Art)
FIG. 1 is a block diagram of a conventional analog hearing aid.

In accordance with one aspect of the invention, hearing assistive apparatus includes sound replay capability (i.e., the capability of reproducing sound that occurred prior to the current time). Hearing assistive apparatus according to the invention can be implemented to enable operation in a replay mode, as well as operation in a current sound mode and/or an off mode. In a replay mode of operation, hearing assistive apparatus according to the invention replays sound that occurred prior to the current time, e.g., replays sound that occurred during a specified duration of time (such as, for example, 5 seconds, 10 seconds or 30 seconds) prior to (e.g., immediately prior to) the current time (herein, such specified duration of time is sometimes referred to as the "replay time"). (Replayed sound may begin at less than a specified duration of time prior to the current time if, for example, the hearing assistive apparatus was not operating at the specified duration of time prior to the current time, e.g., if hearing assistive apparatus that can replay up to 10 seconds of sound has been operating for only 5 seconds.) In a current sound mode of operation, hearing assistive apparatus according to the invention reproduces sound as the sound occurs; in particular, when operating in current sound mode, hearing assistive apparatus according to the invention can enhance (e.g., increase the volume of and/or filter) sound as the sound occurs, as a conventional hearing aid. In an off mode of operation, hearing assistive apparatus according to the invention does not produce sound.

In accordance with another aspect of the invention, hearing assistive apparatus can be implemented so that part of the hearing assistive apparatus is spatially separated (i.e., spaced apart) from another part of the hearing assistive apparatus. In particular, hearing assistive apparatus according to the invention can be implemented so that part of the hearing assistive apparatus is spatially separated from another part of the hearing assistive apparatus (e.g., sound production apparatus) that is adapted to be mounted on a wearer on, in, or proximate to an ear of the wearer. (For convenience, a part of hearing assistive apparatus that is adapted to be mounted on a wearer on, in, or-proximate to an ear of the wearer is sometimes referred to herein as "ear-mounted hearing assistive apparatus.") For example, hearing assistive apparatus according to the invention can be implemented so that user input apparatus of the hearing assistive apparatus, sound replay apparatus of the hearing assistive apparatus and/or sound data acquisition apparatus of the hearing assistive apparatus are spatially separated, in whole or in part, from ear-mounted sound production apparatus of the hearing assistive apparatus. Further, each of the user input apparatus, sound replay apparatus and/or sound data acquisition apparatus can be implemented in separate apparatus or together in the same apparatus with other of the user input apparatus, sound replay apparatus and/or sound data acquisition apparatus.

Hearing assistive apparatus according to the invention assists a user of the hearing assistive apparatus in hearing sound that occurs in the vicinity of the user. A user of hearing assistive apparatus according to the invention can be any sentient being capable of hearing. It is anticipated that, typically, a user of hearing assistive apparatus according to the invention will be a person; however, a user of hearing assistive apparatus according to the invention can also be an animal. In many embodiments of the invention, hearing assistive apparatus according to the invention is adapted to be "worn" (the user of such hearing assistive apparatus according to the invention is sometimes referred to herein as a "wearer" of the hearing assistive apparatus). Herein, hearing assistive apparatus according to the invention is "worn" when the hearing assistive apparatus or part or parts thereof is mounted on a wearer. For example, in many embodiments of hearing assistive apparatus according to the invention, the sound production apparatus of the hearing assistive apparatus is implemented as ear-mounted hearing assistive apparatus. The invention can be implemented in hearing assistive apparatus including any type of ear-mounted hearing assistive apparatus, such as hearing assistive apparatus positioned completely in the ear canal, partially in the ear canal, on the ear or behind the ear. In some embodiments of the invention including ear-mounted sound production apparatus, some or all of the other components of hearing assistive apparatus according to the invention, such as sound data acquisition apparatus, sound replay apparatus and/or user input apparatus, are also implemented in ear-mounted hearing assistive apparatus. In some embodiments of the invention, some components of hearing assistive apparatus according to the invention are implemented in apparatus that is spatially separated from ear mounted hearing assistive apparatus; such apparatus may or may not be worn by a wearer of the hearing assistive apparatus, depending on the implementation of the invention, as discussed in more detail below.

Figure 3:
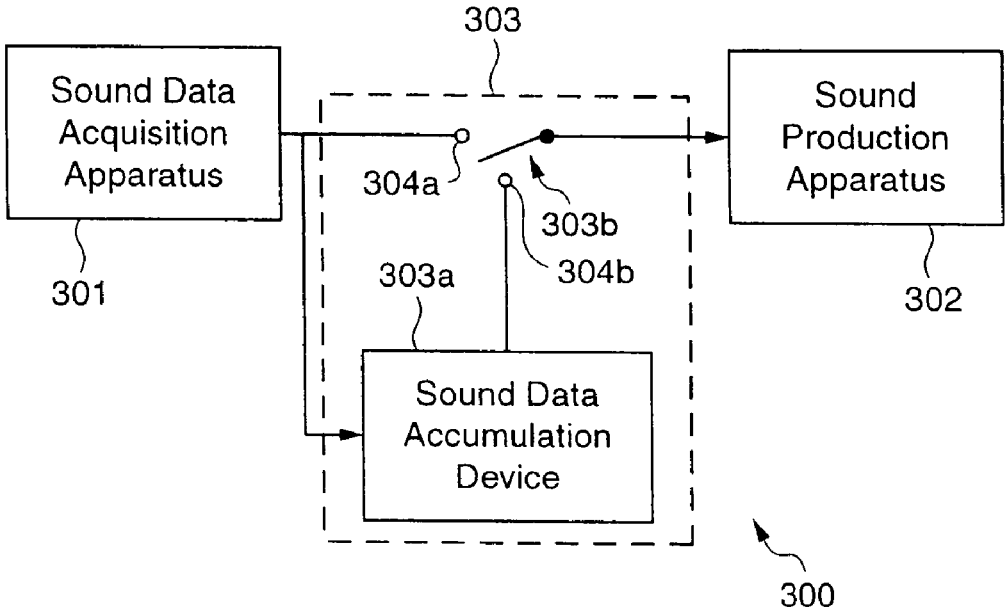
FIG. 3 is a block diagram of a hearing assistive device according to an embodiment of the invention.

FIG. 3 is a block diagram of a hearing assistive device 300 according to an embodiment of the invention. The hearing assistive device 300 includes a sound data acquisition apparatus 301, a sound production apparatus 302 and a sound replay apparatus 303.

The sound data acquisition apparatus 301 is adapted to acquire sound data representing sound that occurs in the vicinity of the hearing assistive device 300 (and, thus, in the vicinity of a user of the hearing assistive device 300). The sound data acquired by the sound data acquisition apparatus 301 at each current time is sometimes referred to herein as "current sound data." The sound data can be represented in any appropriate manner: the type of representation of the sound data will depend upon the device(s) used to implement the sound data acquisition apparatus 301. For example, it is anticipated that, typically, as is the case for conventional hearing aids, a hearing assistive device according to the invention (and, in particular, the sound data acquisition apparatus) will be implemented as an electronic device in which the sound data is represented by electrical signals. However, the invention also contemplates embodiments of a hearing assistive device according to the invention in which the sound data is represented in other ways. The sound data acquisition apparatus 301 can be implemented using sound sensing apparatus that is adapted to sense sound in the vicinity of the hearing assistive device 300 and convert the sensed sound to sound data (e.g., electrical signals representing sound data). Sound sensing apparatus for use in a hearing assistive device according to the invention can be implemented using any appropriate device(s) that accomplish the functionality of the sound sensing apparatus, such as any microphone conventionally used in a hearing aid. The sound data acquisition apparatus 301 can also be implemented using—in addition to, or instead of, sound sensing apparatus—a receiver that receives signal(s) representing sensed sound that are transmitted by one or more transmitter(s). Each transmitter obtains sound data from sound sensing apparatus associated with the transmitter and can be positioned away from the user of the hearing assistive device (but at a location that enables sensing of sound in the vicinity of the user).

The sound production apparatus 302 is adapted to produce sound in accordance with sound data acquired by the sound data acquisition apparatus. As described further below, in accordance with the invention, the sound data received by the sound production apparatus 302 can be either current sound data or replay sound data, the latter enabling replaying of sound represented by sound data acquired by the hearing assistive device 300. The sound production apparatus 302 can be implemented using any appropriate device(s) that accomplish the functionality of the sound production apparatus 302, e.g., any speaker as conventionally used in a hearing aid.

The sound replay apparatus 303 is adapted, as described in more detail below, to enable replay of sound represented by sound data acquired by the hearing assistive device 300. The sound replay apparatus 303 includes a sound data accumulation device 303*a* and a sound data selection device 303*b*. The sound data accumulation device 303*a* is adapted to enable accumulation of sound data (sometimes referred to herein as "replay sound data") representing sound occurring for up to a specified duration of time that precedes the current time. Exemplary implementations of the sound data accumulation device 303*a* are described further below. The sound data selection device 303*b* is adapted to enable selection of either the current sound data (the sound data selection device 303*b* is in position 304*a*) or the replay sound data (the sound data selection device 303*b* is in position 304*b*) to be transmitted to the sound production apparatus 302 for use in producing sound. The sound data selection device 303*b* can be implemented using, for example, one or more transistors or a multiplexer (which can be implemented using transistors). The sound data selection device 303*b* can also be implemented by software and/or firmware (one or more computer programs and/or data structures) that is stored and operates on appropriate hardware (e.g., processor, memory).

Figure 2:
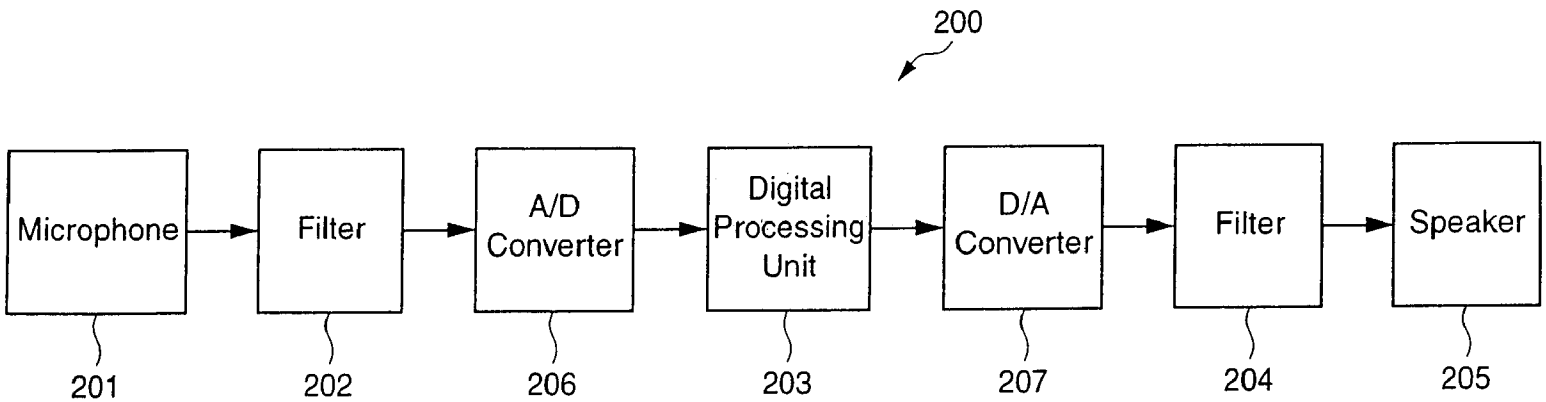
FIG. 2 (Prior Art)
FIG. 2 is a block diagram of a conventional digital hearing aid.

The invention can advantageously be implemented so that the sound data accumulation device 303*a* and the sound data selection device 303*b* of the sound replay apparatus 303 are constructed together as a single integrated apparatus (e.g., as part of a single integrated circuit). Using such an implementation, a conventional hearing aid can be modified to produce a hearing assistive device according to the invention (compare FIGS. 4 and 5, described below, to FIGS. 1 and 2, respectively, described above). For example, an integrated circuit implementing the sound replay apparatus 303 of a hearing assistive device according to the invention can be inserted at an appropriate location in the circuitry used to implement a conventional hearing aid.

Figure 4:
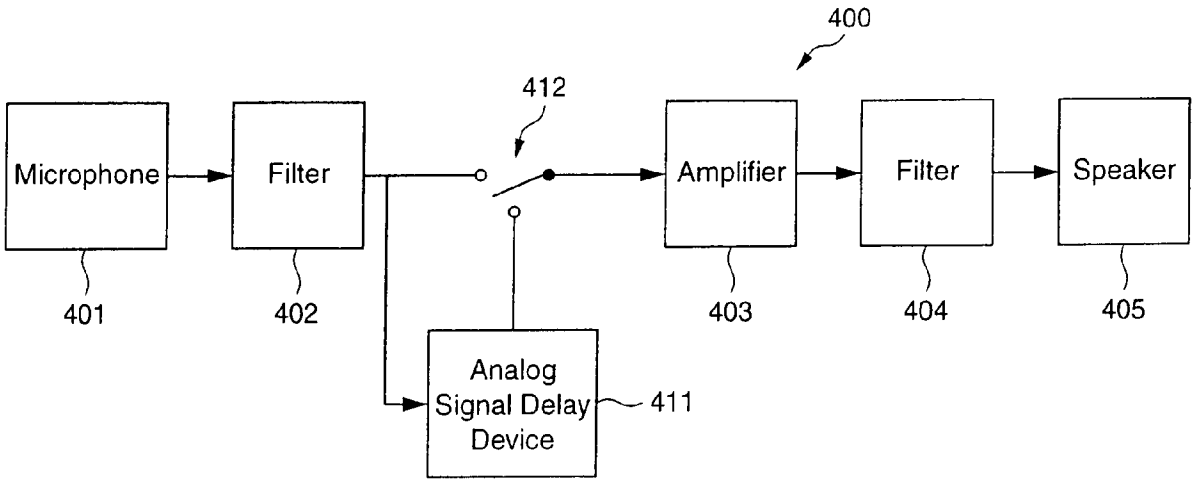
FIG. 4 is a block diagram of an analog hearing assistive device according to an embodiment of the invention.

FIG. 4 is a block diagram of an analog hearing assistive device 400 according to the invention. The hearing assistive device 400 includes a microphone 401, filter 402, amplifier 403, filter 404 and speaker 405 that can be constructed and operate in the same or similar manner as the microphone 101, filter 102, amplifier 103, filter 104 and speaker 105, respectively, of the conventional analog hearing aid 100 described above (FIG. 1). (Like the hearing aid 100, the hearing assistive device 400 can also be implemented to include a receiver instead of, or in addition to, the microphone 401, signal(s) representing sensed sound being transmitted to the receiver by one or more transmitter(s) that can be positioned away from the user of the hearing assistive device 400.) The microphone 401, filter 402, amplifier 403, filter 404 and speaker 405 can be embodied by, for example, any apparatus used in conventional analog hearing aids. Further, each of the filter 402, amplifier 403 and filter 404 can be implemented using hardware, software and/or firmware, using apparatus, method(s) and/or computer program(s) (which computer program(s) can include instructions and/or data for effecting the functionality of the computer program(s)) as known to those skilled in the art. The hearing assistive device 400 also includes analog signal delay device 411 and sound data selection device 412, which together comprise a sound replay apparatus. In general, the analog signal delay device 411 and the sound data selection device 412 can be embodied by any apparatus that accomplishes the functions of the analog signal delay device 411 and the sound data selection device 412 as described herein, as can be understood by those skilled in the art in view of the description herein. For example, like the sound data selection device 303*b* of the hearing assistive device 300, the sound data selection device 412 can be implemented using one or more transistors or a multiplexer, or the sound data selection device 412 can be implemented by software and/or firmware that is stored and operates on appropriate hardware. A particular way of implementing the analog signal delay device 411 is described below with respect to FIG. 6.

During use of the hearing assistive device 400, the sound data selection device 412 is positioned, in response to appropriate input, to cause sound data to be transmitted to the amplifier 403 (and, eventually, to the speaker 405) either directly from the microphone 401 (and filter 402) or through the analog signal delay device 411. In the former case, the hearing assistive device 400 can operate in the manner of a normal analog hearing aid, enhancing sound as the sound occurs. In the latter case, the hearing assistive device 400 operates in a replay mode in accordance with the invention, replaying sound during a replay time.

Figure 5:
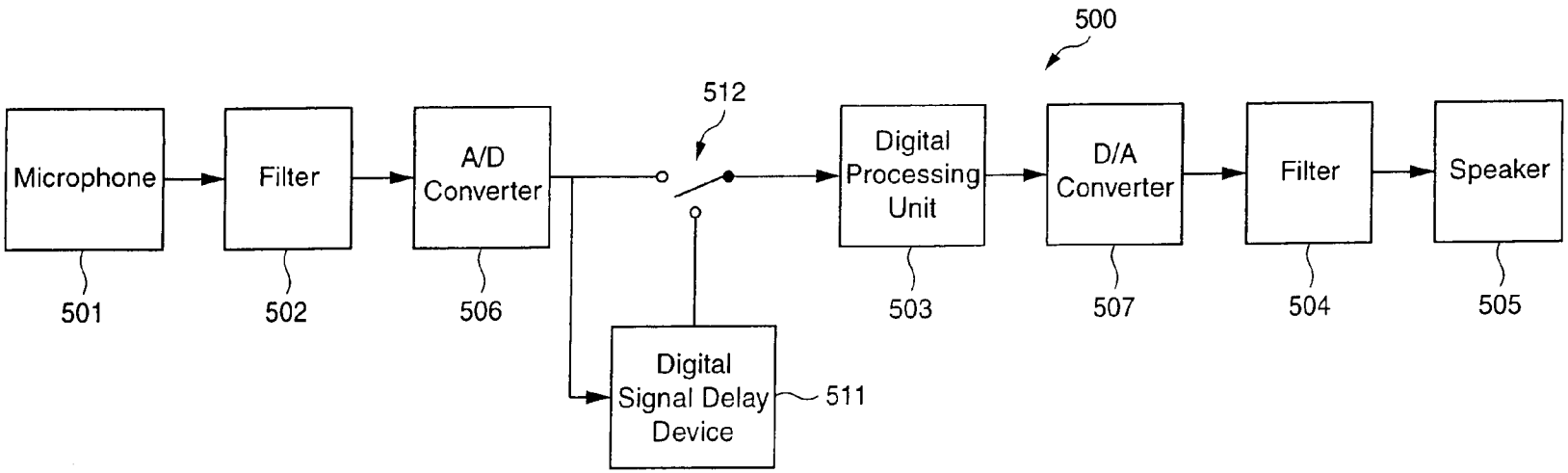
FIG. 5 is a block diagram of a digital hearing assistive device according to an embodiment of the invention.

FIG. 5 is a block diagram of a digital hearing assistive device 500 according to the invention. The hearing assistive device 500 includes a microphone 501, filter 502, digital processing unit 503, filter 504, speaker 505, A/D converter 506 and D/A converter 507 that can be constructed and operate in the same or similar manner as the microphone 201, filter 202, digital processing unit 203, filter 204, speaker 205, A/D converter 206 and D/A converter 207, respectively, of the conventional digital hearing aid 200 described above (FIG. 2). (Like the hearing aid 200, the hearing assistive device 500 can also be implemented to include a receiver instead of, or in addition to, the microphone 501, signal(s) representing sensed sound being transmitted to the receiver by one or more transmitter(s) that can be positioned away from the user of the hearing assistive device 500.) The microphone 501, filter 502, digital processing unit 503, filter 504, speaker 505, A/D converter 506 and D/A converter 507 can be embodied by, for example, any apparatus used in conventional digital hearing aids. Further, each of the filter 502, digital processing unit 503, filter 504, A/D converter 506 and D/A converter 507 can be implemented using hardware, software and/or firmware, using apparatus, method(s) and/or computer program(s) (which computer program(s) can include instructions and/or data for effecting the functionality of the computer program(s)) as known to those skilled in the art. The hearing assistive device 500 also includes digital signal delay device 511 and sound data selection device 512, which together comprise a sound replay apparatus. In general, the digital signal delay device 511 and the sound data selection device 512 can be embodied by any apparatus that accomplishes the functions of the digital signal delay device 511 and the sound data selection device 512 as described herein, as can be understood by those skilled in the art in view of the description herein. For example, like the sound data selection device 303*b* of the hearing assistive device 300, the sound data selection device 512 can be implemented using one or more transistors or a multiplexer, or the sound data selection device 512 can be implemented by software and/or firmware that is stored and operates on appropriate hardware. The digital signal delay device 511 can also be implemented using hardware, software and/or firmware. A particular way of implementing the digital signal delay device 511 is described below with respect to FIG. 7.

The hearing assistive device 500 operates in a manner similar to that of the hearing assistive device 400 described above. During use of the hearing assistive device 500, the sound data selection device 512 is positioned, in response to appropriate input, to cause sound data to be transmitted to the digital processing unit 503 (and, eventually, to the speaker 507) either directly from the microphone 501 (and filter 502 and A/D converter 506) or through the digital signal delay device 511. In the former case, the hearing assistive device 500 can operate in the manner of a normal digital hearing aid, enhancing sound as the sound occurs. In the latter case, the hearing assistive device 500 operates in a replay mode in accordance with the invention, replaying sound during a replay time.

Though the filters 402 and 404 and the filters 502 and 504 are described above as part of the hearing assistive devices 400 and 500, respectively, either or both of those filters can be eliminated from the hearing assistive device 400 or the hearing assistive device 500. Further, the hearing assistive device 500 can include one or more filters between components of the hearing assistive device 500 other than as illustrated in FIG. 5. Like the filters 402 and 404 and the filters 502 and 504, such filter(s) can be implemented using hardware, software and/or firmware, using apparatus, method(s) and/or computer program(s) as known to those skilled in the art.

Additionally, the hearing assistive devices 400 and 500 can include other components not illustrated in FIGS. 4 and 5 that may be necessary or desirable to effect the functionality of the hearing assistive device 400 or 500. For example, the hearing assistive device 500 can include an amplifier between the D/A converter 507 and the speaker 505; since the strength of the electrical signal produced by the D/A converter 507 is often smaller than is desirable for input to the speaker 505, such an amplifier may be necessary or desirable. Like the amplifier 403 of the hearing assistive device 400, such an amplifier can be implemented using hardware, software and/or firmware, using apparatus, method(s) and/or computer program(s) as known to those skilled in the art.

Further, the signal delay device and sound data selection device in the hearing assistive devices 400 and 500 can be located other than as shown in FIGS. 4 and 5. For example, the analog signal delay device 411 and sound data selection device 412 can be positioned between the amplifier 403 and the speaker 405. Or, for example, the digital signal delay device 511 and sound data selection device 512 can be positioned between the digital processing unit 503 and the D/A converter 507. Generally, the sound replay apparatus (e.g., signal delay device and sound data selection device) of a hearing assistive device according to the invention can be situated at any location among the components of a conventional hearing aid that enables the functionality of the sound replay apparatus to be effected.

Figure 6:
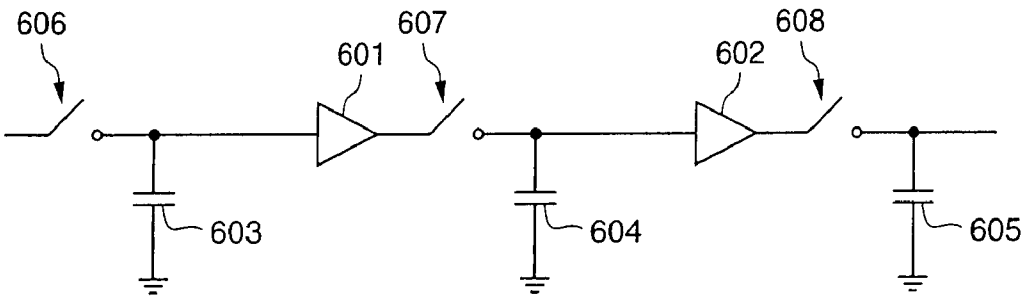
FIG. 6 is a schematic diagram illustrating an embodiment of a signal delay device that can be used in a hearing assistive device according to the invention.
Figure 7:
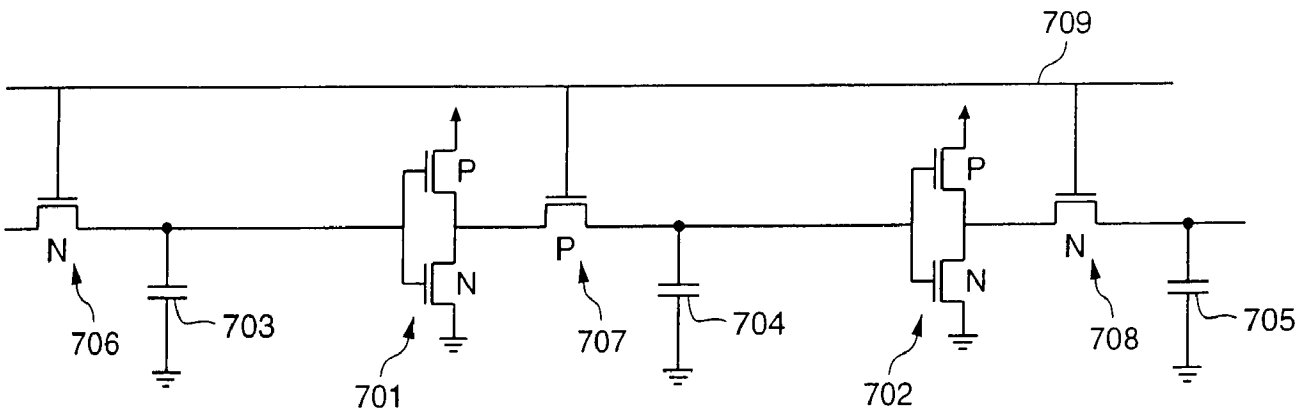
FIG. 7 is a schematic diagram illustrating a digital signal delay device, in accordance with the embodiment of a signal delay device illustrated in FIG. 6, that can be used in a digital hearing assistive device according to the invention.

A signal delay device for use in the hearing assistive device 400 or the hearing assistive device 500 can be constructed as an alternating series of amplifiers (or buffers) and capacitors, with a switch located between each adjacent capacitor and amplifier (or buffer). FIG. 6 is a schematic diagram illustrating such an embodiment of a signal delay device, known to those skilled in the art as a "bucket brigade device." FIG. 7 is a schematic diagram illustrating a digital signal delay device, in accordance with the embodiment of a signal delay device illustrated in FIG. 6, that can be used in a digital hearing assistive device according to the invention. For simplicity, only amplifiers 601 and 602, capacitors 603, 604 and 605, and switches 606, 607 and 608 of the signal delay device are shown in FIG. 6, and only inverting amplifiers 701 and 702, capacitors 703, 704 and 705, and switches 706, 707 and 708 of the digital signal delay device are shown in FIG. 7. As will be made clearer by the further description below, to enable accumulation of sound data for an adequate duration of time, the signal delay devices shown in FIGS. 6 and 7 include many more amplifiers (or buffers), capacitors and switches than those shown in FIGS. 6 and 7.

In the signal delay devices illustrated in FIGS. 6 and 7, each of the switches are alternately opened and closed at a specified frequency. Adjacent switches are opened and closed 180 degrees out of phase with respect to each other, e.g., in the signal delay device illustrated in FIG. 6, when switches 606 and 608 are open, switch 607 is closed, and vice versa. (Operation of the switches in the signal delay devices of FIGS. 6 and 7 can be effected using one or more control signals. In FIG. 7, for example, the switches are constructed so that a single switch control signal transmitted along the control signal line 709 effects the desired operation of the switches. The control signal is not illustrated in FIG. 6.) When the switches 606 and 608 are closed and the switch 607 is open, the capacitors 603 and 605 accumulate charge. When the switches 606 and 608 are open and the switch 607 is closed, the capacitor 604 accumulates charge. Thus, for each change in state of the switches, an electrical signal is advanced from one capacitor to the next. Consequently, sound data represented by electrical signals traveling through the series of amplifiers (or buffers), capacitors and switches is delayed by an amount of time equal to the number of sets of amplifier (or buffer), capacitor and switch divided by twice the switching frequency.

The following illustrates how a signal delay device as illustrated in FIG. 6 or FIG. 7 can be constructed for use in a hearing assistive device according to the invention. Voice sounds include frequencies between about 100 hertz to about 4 kilohertz. To adequately sample voice sounds, the sample rate should be at least twice as great as the frequency of the voice sounds being sampled. Thus, to obtain adequate sampling of the highest frequency voice sounds, a hearing assistive device according to the invention should obtain sound data at a rate of at least about 8 kilohertz. The switching frequency of the switches of the signal delay device must be at least as great as the rate at which sound data is acquired by the hearing assistive device. Thus, to enable a replay of the last five seconds of sound prior to a current time, the signal delay device of FIG. 6 must include 80,000 sets of amplifier (or buffer), capacitor and switch (i.e., 80,000 amplifiers/buffers, 80,000 capacitors, 80,000 switches). In the digital signal delay device of FIG. 7, the number of required components is further affected by the number of bits used to represent each piece of sound data, since each bit is represented by a separate electrical signal. If, for example, 8-bit digital signals are used, enabling replay of the last five seconds of sound prior to a current time requires 1,920,000 transistors and 640,000 capacitors (a switching frequency of 8000 hz, 5 seconds of sound data accumulation, 8 bits for each piece of sound data, 3 transistors and 1 capacitor for delaying one bit of a piece of sound data). If it is desired to obtain sound data including even higher frequency content (e.g., to accurately reproduce some musical sounds), the number of required electrical components is even greater. For example, a "high fidelity" digital hearing assistive device according to the invention may be intended to obtain sound data including frequencies up to 20 kilohertz. The hearing assistive device sample rate and the switching frequency of the switches of the signal delay device should therefore be at least about 40 kilohertz. Accumulation of 5 seconds of sound data in such a digital hearing assistive device according to the invention (using 8 bit digital signals) requires 9,600,000 transistors and 3,200,000 capacitors. Similarly, if digital signals including a greater number of bits are used, the number of required electrical components increases, e.g., the use of 16 bit digital signals doubles the number of electrical components required as compared to the number required when 8 bit digital signals are used. Finally, accumulation of replay sound data for a replay time of greater than 5 seconds will also increase the required number of electrical components in the signal delay device, the number increasing in direct proportion to the increase in replay time.

Figure 8:
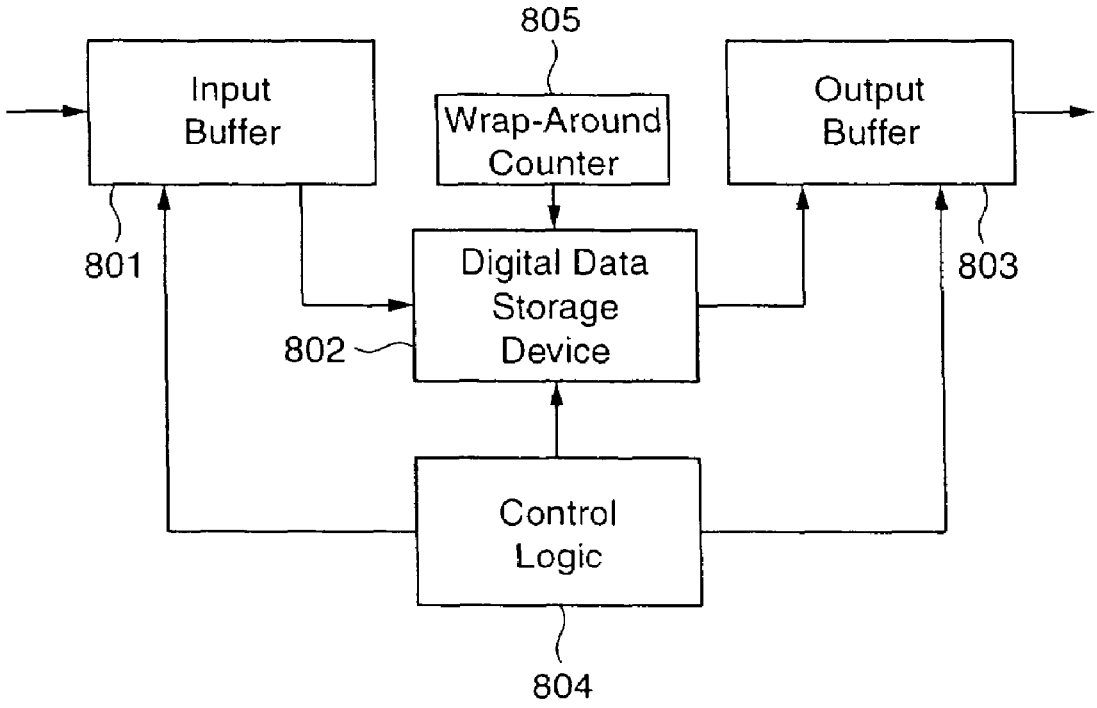
FIG. 8 is a schematic diagram illustrating another embodiment of a digital signal delay device that can be used in a digital hearing assistive device according to the invention.

FIG. 8 is a schematic diagram illustrating another embodiment of a digital signal delay device that can be used in a digital hearing assistive device according to the invention (e.g., can be used to implement the digital signal delay device 511 of the hearing assistive device 500 of FIG. 5). The digital signal delay device according to this embodiment includes an input buffer 801, a digital data storage device 802, an output buffer 803, control logic 804 and a wrap-around counter 805. As sound data is acquired by a sound data acquisition apparatus of the hearing assistive device according to the invention, the sound data is input to the input buffer 801. Under control of the control logic 804, sound data is output from the input buffer 801 and input to the digital data storage device 802. When the digital data storage device 802 stores an amount of sound data that corresponds to a specified replay time, at the time of inputting new sound data into the digital data storage device, the control logic 804 causes the sound data that has been stored longest in the digital data storage device 802 to be output from the digital data storage device 802 and input to the output buffer 803. The wrap-around counter 805 keeps track of the data storage location in the digital data storage device 802 to which new sound data should be stored and from which, if applicable, previously stored sound data should be read. If the hearing assistive device is controlled so that replay sound data is to be provided to the sound production apparatus of the hearing assistive device, then the sound data is output from the output buffer 803 for use by the sound production apparatus. Otherwise, the sound data stored in the output buffer 803 is replaced by the next sound data output from the digital data storage device 802. Each of the input buffer 801, digital data storage device 802, output buffer 803, control logic 804 and wraparound counter 805 can be implemented using conventional apparatus, method(s) and/or computer program(s), as known to those skilled in the art, in a manner that will be understood by those skilled in the art in view of the description herein. In particular, the digital data storage device can be implemented using random access memory (RAM). Either SRAM or DRAM can be used. Increasingly high density RAM has been developed in recent years and the invention can advantageously make use of such high density RAM to enable construction of a digital signal delay device having sufficient data storage capacity to store an amount of replay sound data that enables an adequately long replay time and that is sufficiently small to be used in a hearing assistive device. Further, as understood by those skilled in the art, the digital data storage device 802 can be implemented using multiple data storage devices. For example, when each piece of sound data is represented by multiple bits (e.g., 8 or 16 bits), a piece of sound data can be stored by simultaneously inputting one or more of the bits of the piece of sound data into each of multiple data storage devices.

As discussed above, all hearing aids must be, or preferably are, constructed to be relatively small apparatus. As can be appreciated from the example above, until recently, manufacturing processes for electronic devices (e.g., integrated circuit fabrication processes) have not enabled the construction of a signal delay device that can both accumulate an appreciable amount of replay sound data (e.g., several seconds) and be made sufficiently small for use in a hearing assistive device. Additionally, the development of "denser" batteries (i.e., batteries that store more energy per unit volume) has enabled the manufacture of batteries that supply adequate power to operate sound replay apparatus in accordance with the invention, yet are sufficiently small to be used in a hearing assistive device. Thus, until recently, construction of a hearing assistive device according to the invention that includes sound replay capability may not have been possible or feasible. Advances in technology, as described above, have, in particular, enabled construction of a signal delay device that is small enough for a hearing assistive device and can accumulate a sufficient amount of sound data to allow an adequately long replay time and production of a sound display of adequate fidelity (i.e., by enabling sufficiently large sample rates and/or high bit data representations).

Figure 9:
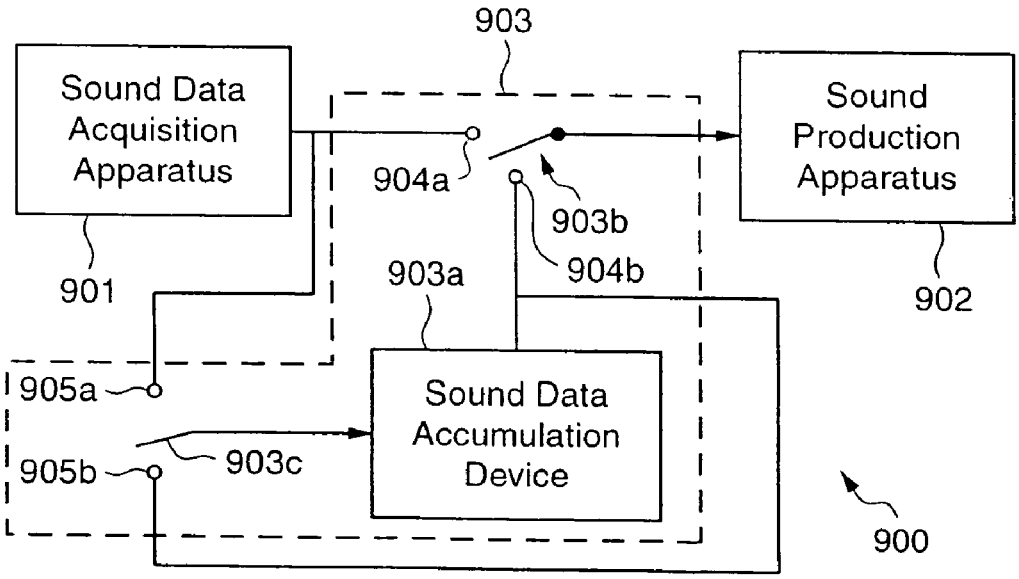
FIG. 9 is a block diagram of a hearing assistive device, according to another embodiment of the invention, that enables replay sound data to be successively replayed more than one time.

FIG. 9 is a block diagram of a hearing assistive device 900 according to another embodiment of the invention. The hearing assistive device 900 includes a sound data acquisition apparatus 901, a sound production apparatus 902 and a sound replay apparatus 903. The sound data acquisition apparatus 901 and sound production apparatus 902 can be constructed and operate in the same or similar manner as the sound data acquisition apparatus 301 and sound production apparatus 302 of the hearing assistive device 300 described above with respect to FIG. 3. Additionally, the sound data accumulation device 903*a* and sound data selection device 903*b* of the sound replay apparatus 903 can be constructed and operate in the same or similar manner as the sound data accumulation device 303*a* and sound data selection device 303*b* of the sound replay apparatus 303 of the hearing assistive device 300 described with respect to FIG. 3. However, in addition to the sound data accumulation device 903*a* and sound data selection device 903*b*, the sound replay apparatus 903 includes a sound data selection device 903*c* that is positioned before the input to the sound data accumulation device 903*a*. During operation of the hearing assistive device 900 in current sound mode (i.e., when the sound data selection device 903*b* is in position 904*a* to cause current sound data to be transmitted from the sound data acquisition apparatus 901 to the sound production apparatus 902), the sound data selection device 903*c* is in position 905*a* so that the most recently acquired sound data (the current sound data) is continually input from the sound data acquisition apparatus 901 into the sound data accumulation device 903*a* to become potential replay sound data. During operation of the hearing assistive device 900 in replay mode (i.e., when the sound data selection device 903*b* is in position 904*b* to cause replay sound data to be transmitted from the sound data accumulation device 903*a* to the sound production apparatus 902), the sound data selection device 903*c* is in position 905*b* to cause replay sound data transmitted from the sound data accumulation device 903*a* to be input back into the sound data accumulation device 903*a*, thus enabling the replay sound data existing at the time of beginning operation of the hearing assistive device 900 in replay mode to be successively replayed more than one time. In the hearing assistive device 900, sound produced from the replay sound data is repeated until operation of the hearing assistive device 900 is switched from replay mode to current sound mode. Like the sound data selection device 903*b*, the sound data selection device 903*c* can be implemented using, for example, one or more transistors or a multiplexer, or the sound data selection device 903*c* can be implemented by software and/or firmware that is stored and operates on appropriate hardware.

In the embodiments of the invention described above, a hearing assistive device according to the invention can operate in a current sound mode (i.e., a mode in which the hearing assistive device reproduces sound as the sound occurs) or in a replay mode (i.e., a mode in which the hearing assistive device replays sound that occurred prior to the current time). Though operation of a hearing assistive device in current sound mode can assist a user of the hearing assistive device in hearing sound (particularly when the reproduced sound is enhanced as compared to the original sound), such operation can produce undesirable effects for some users. For example, operation of a hearing assistive device in current sound mode can change in an unintended manner the way in which sound is heard (e.g., by changing the timbre or other characteristic of the sound). Operation of the hearing assistive device in current sound mode may also produce an uncomfortable, unpleasant or disconcerting physical sensation by blocking the natural movement of air into and out of the ear. Operation of the hearing assistive device in current sound mode may also produce a psychological effect, affecting how the user of the hearing assistive device feels about the sounds that they hear. Consequently, particularly for users of a hearing assistive device whose hearing is impaired relatively mildly, it can be desirable for a hearing assistive device according to the invention to have the capability of not operating in current sound mode when the hearing assistive device is not being operated in replay mode. Further, a hearing assistive device according to the invention including a replay capability can be targeted to a new class of prospective users of a hearing assistive device: people whose hearing is unimpaired (or not impaired to a degree that makes using a conventional hearing aid necessary or desirable). Such prospective users of a hearing assistive device have little or no need for operation of a hearing assistive device according to the invention in current sound mode and do not desire to use the hearing assistive device to enhance sound, but, rather, to enable use of the sound replay capability provided by operation of the hearing assistive device in replay mode. For such prospective users of a hearing assistive device, it is even more desirable for a hearing assistive device according to the invention to have the capability of not operating in current sound mode when the hearing assistive device is not being operated in replay mode.

A hearing assistive device according to the invention can be implemented so that the hearing assistive device can operate in an off mode in which the hearing assistive device does not provide sound to a user of the hearing assistive device, in addition to a replay mode in which the hearing assistive device replays sound that occurred prior to the current time. Such a hearing assistive device according to the invention can also, but need not necessarily, be implemented to include a current sound mode of operation in which the hearing assistive device can enhance sound as the sound occurs. FIGS. 10A, 10B, 11A and 11B, described below, illustrate embodiments of a hearing assistive device according to the invention including an off mode of operation. In general (i.e., except as may be necessitated otherwise by the functionality of a particular embodiment, as can be appreciated by those skilled in the art), the particular implementations of a hearing assistive device according to the invention and components thereof (see, e.g., FIGS. 4, 5, 6 and 7 and associated description above), as well as other aspects of the invention, described elsewhere herein can also be used with hearing assistive devices according to the embodiments of the invention illustrated in FIGS. 10A, 10B, 11A and 11B.

Figure 10A:
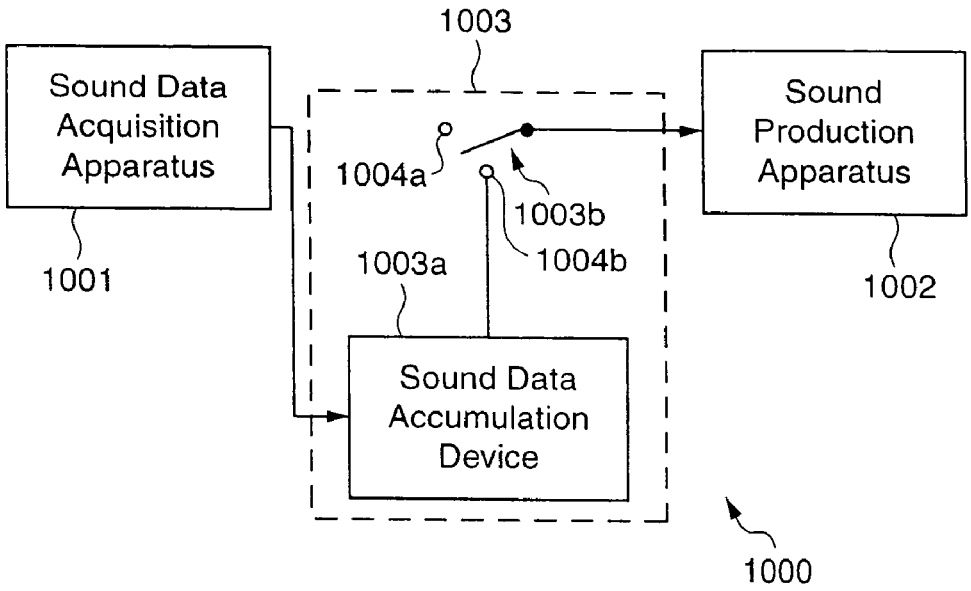
FIG. 10A is a block diagram of a hearing assistive device, according to another embodiment of the invention, including a replay mode of operation and an off mode of operation.

FIG. 10A is a block diagram of a hearing assistive device 1000, according to another embodiment of the invention, including a replay mode of operation and an off mode of operation. The hearing assistive device 1000 includes a sound data acquisition apparatus 1001, a sound production apparatus 1002 and a sound replay apparatus 1003. The sound data acquisition apparatus 1001 and sound production apparatus 1002 can be constructed and operate in the same or similar manner as the sound data acquisition apparatus 301 and sound production apparatus 302 of the hearing assistive device 300 described above with respect to FIG. 3. Additionally, the sound data accumulation device 1003*a* of the sound replay apparatus 1003 can be constructed and operate in the same or similar manner as the sound data accumulation device 303*a* of the sound replay apparatus 303 of the hearing assistive device 300 described with respect to FIG. 3. The sound data selection device 1003*b* is adapted to enable selection of either an off mode (the sound data selection device 1003*b* is in position 1004*a*) in which no sound data is transmitted from the sound data acquisition apparatus 1001 to the sound production apparatus 1002, or a replay mode (the sound data selection device 1003*b* is in position 1004*b*) in which replay sound data is transmitted from the sound data accumulation device 1003*a* of the sound replay apparatus 1003 to the sound production apparatus 1002 for use in producing sound. Like the sound data selection device 303*b* of the hearing assistive device 300, the sound data selection device 1003*b* can be implemented using, for example, one or more transistors or a multiplexer, or the sound data selection device 1003*b* can be implemented by software and/or firmware that is stored and operates on appropriate hardware.

Figure 10B:
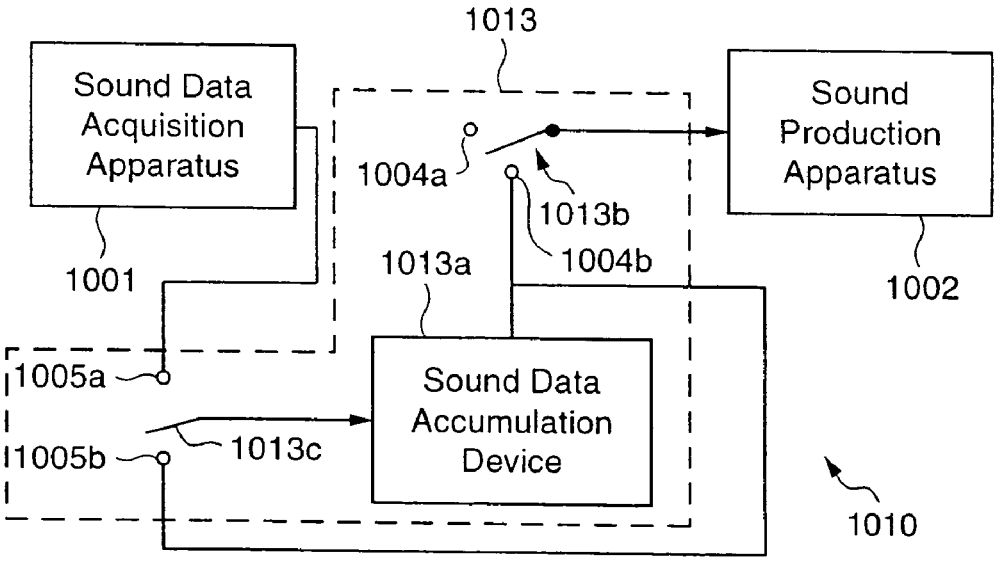
FIG. 10B is a block diagram of a hearing assistive device, according to yet another embodiment of the invention, including a replay mode of operation and an off mode of operation, that enables replay sound data to be successively replayed more than one time.

FIG. 10B is a block diagram of a hearing assistive device 1010, according to yet another embodiment of the invention, including a replay mode of operation and an off mode of operation, that enables replay sound data to be successively replayed more than one time. The hearing assistive device 1010 includes a sound data acquisition apparatus 1001, a sound production apparatus 1002 and a sound replay apparatus 1013. The sound data acquisition apparatus 1001 and sound production apparatus 1002 can be constructed and operate as described above with respect to the hearing assistive device 1000 illustrated in FIG. 10A. The sound replay apparatus 1013 includes a sound data accumulation device 1013*a* and a sound data selection device 1013*b*, which can be constructed and operate in the same or similar manner as the sound data accumulation device 1003*a* and sound data selection device 1003*b* of the hearing assistive device 1000. However, in addition to the sound data accumulation device 1013*a* and sound data selection device 1013*b*, the sound replay apparatus 1013 includes a sound data selection device 1013*c* that is positioned before the input to the sound data accumulation device 1013*a*. During operation of the hearing assistive device 1010 in off mode (i.e., when the sound data selection device 1013*b* is in position 1004*a* to inhibit sound data from being transmitted to the sound production apparatus 1002), the sound data selection device 1013*c* is in position 1005*a* so that the current sound data is continually input from the sound data acquisition apparatus 1001 into the sound data accumulation device 1013*a* to become potential replay sound data. During operation of the hearing assistive device 1010 in replay mode (i.e., when the sound data selection device 1013*b* is in position 1004*b* to cause replay sound data to be transmitted from the sound data accumulation device 1013*a* of the sound replay apparatus 1013 to the sound production apparatus 1002), the sound data selection device 1013*c* is in position 1005*b* to cause replay sound data transmitted from the sound data accumulation device 1013*a* to be input back into the sound data accumulation device 1013*a*, thus enabling the replay sound data existing at the time of beginning operation of the hearing assistive device 1010 in replay mode to be successively replayed more than one time. In the hearing assistive device 1010, sound produced from the replay sound data is repeated until operation of the hearing assistive device 1010 is switched from replay mode to off mode. Like the sound data selection device 1013*b*, the sound data selection device 1013*c* can be implemented using, for example, one or more transistors or a multiplexer, or the sound data selection device 1013*c* can be implemented by software and/or firmware that is stored and operates on appropriate hardware.

Figure 11A:
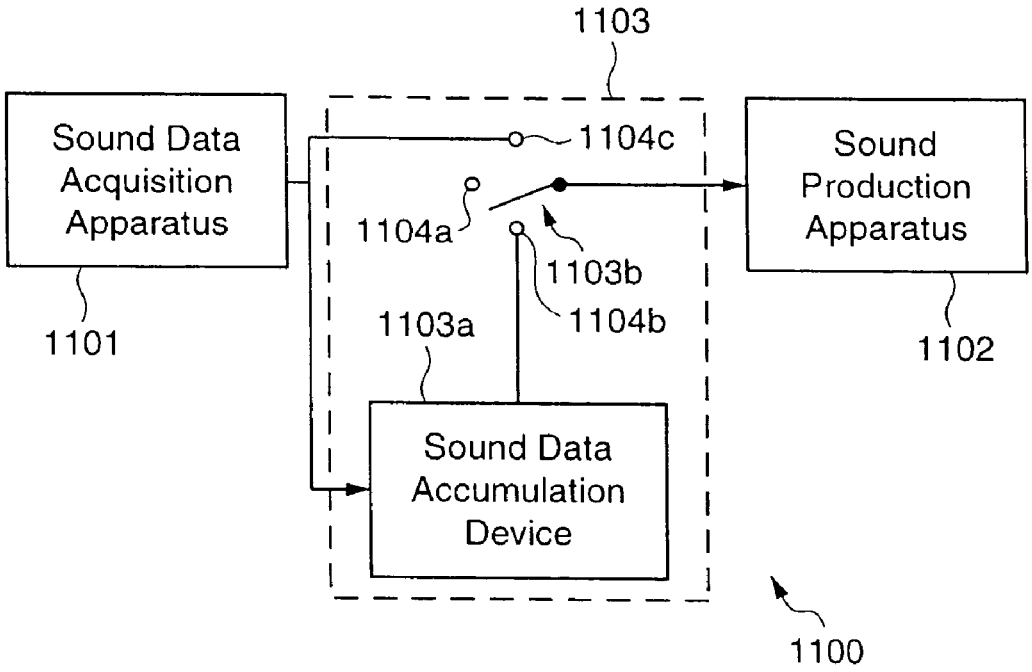
FIG. 11A is a block diagram of a hearing assistive device, according to another embodiment of the invention, including a replay mode of operation, a current sound mode of operation and an off mode of operation.

FIG. 11A is a block diagram of a hearing assistive device 1100, according to another embodiment of the invention, including a replay mode of operation, a current sound mode of operation and an off mode of operation. The hearing assistive device 1100 includes a sound data acquisition apparatus 1101, a sound production apparatus 1102 and a sound replay apparatus 1103. The sound data acquisition apparatus 1101 and sound production apparatus 1102 can be constructed and operate in the same or similar manner as the sound data acquisition apparatus 301 and sound production apparatus 302 of the hearing assistive device 300 described above with respect to FIG. 3. Additionally, the sound data accumulation device 1103*a* of the sound replay apparatus 1103 can be constructed and operate in the same or similar manner as the sound data accumulation device 303*a* of the sound replay apparatus 303 of the hearing assistive device 300 described with respect to FIG. 3. The sound data selection device 1103*b* is adapted to enable selection of one of an off mode (the sound data selection device 1103*b* is in position 1104*a*) in which no sound data is transmitted from the sound data acquisition apparatus 1101 to the sound production apparatus 1102, a replay mode (the sound data selection device 1103*b* is in position 1104*b*) in which replay sound data is transmitted from the sound data accumulation device 1103*a* of the sound replay apparatus 1103 to the sound production apparatus 1102 for use in producing sound, or a current sound mode (the sound data selection device 1103*b* is in position 1104*c*) in which current sound data is transmitted from the sound data acquisition apparatus 1101 to the sound production apparatus 1102 for use in producing sound. The sound data selection device 1103*b* can be implemented using, for example, transistors or a multiplexer. The sound data selection device 1103*b* can also be implemented by software and/or firmware that is stored and operates on appropriate hardware.

Figure 11B:
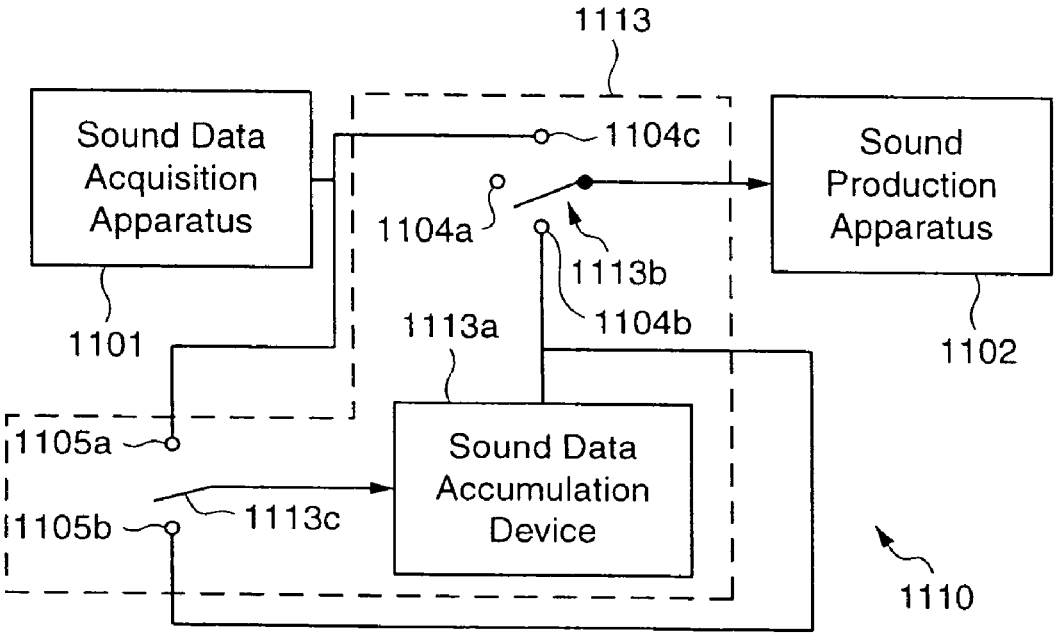
FIG. 11B is a block diagram of a hearing assistive device, according to yet another embodiment of the invention, including a replay mode of operation, a current sound mode of operation and an off mode of operation, that enables replay sound data to be successively replayed more than one time.

FIG. 11B is a block diagram of a hearing assistive device 1110, according to yet another embodiment of the invention, including a replay mode of operation, a current sound mode of operation and an off mode of operation, that enables replay sound data to be successively replayed more than one time. The hearing assistive device 1110 includes a sound data acquisition apparatus 1101, a sound production apparatus 1102 and a sound replay apparatus 1113. The sound data acquisition apparatus 1101 and sound production apparatus 1102 can be constructed and operate as described above with respect to the hearing assistive device 1100 illustrated in FIG. 11A. The sound replay apparatus 1113 includes a sound data accumulation device 1113*a* and a sound data selection device 1113*b*, which can be constructed and operate in the same or similar manner as the sound data accumulation device 1103*a* and sound data selection device 1103*b* of the hearing assistive device 1100. However, in addition to the sound data accumulation device 1113*a* and sound data selection device 1113*b*, the sound replay apparatus 1113 includes a sound data selection device 1113*c* that is positioned before the input to the sound data accumulation device 1113*a*. During operation of the hearing assistive device 1110 in off mode (i.e., when the sound data selection device 1113*b* is in position 1104*a* to inhibit sound data from being transmitted to the sound production apparatus 1102) or in current sound mode (i.e., when the sound data selection device 1113*b* is in position 1104*c* to transmit current sound data from the sound data acquisition apparatus 1101 to the sound production apparatus 1102), the sound data selection device 1113*c* is in position 1105*a* so that the current sound data is continually input from the sound data acquisition apparatus 1101 into the sound data accumulation device 1113*a* to become potential replay sound data. During operation of the hearing assistive device 1110 in replay mode (i.e., when the sound data selection device 1113*b* is in position 1104*b* to cause replay sound data to be transmitted from the sound data accumulation device 1113*a* of the sound replay apparatus 1113 to the sound production apparatus 1102), the sound data selection device 1113*c* is in position 1105*b* to cause replay sound data transmitted from the sound data accumulation device 1113*a* to be input back into the sound data accumulation device 1113*a*, thus enabling the replay sound data existing at the time of beginning operation of the hearing assistive device 1110 in replay mode to be successively replayed more than one time. In the hearing assistive device 1110, sound produced from the replay sound data is repeated until operation of the hearing assistive device 1110 is switched from replay mode to off mode or current sound mode. Like the sound data selection device 1113*b*, the sound data selection device 1113*c* can be implemented using, for example, transistors or a multiplexer, or the sound data selection device 1113*c* can be implemented by software and/or firmware that is stored and operates on appropriate hardware.

When operating in replay mode, a hearing assistive device according to the invention uses replay sound data to produce a sound replay. A hearing assistive device according to the invention can be implemented to process the replay sound data in any desired manner to produce a sound replay having particular characteristic(s). Some examples of such processing are described in more detail below and can be effected using apparatus and methods known to those skilled in the relevant arts. The replay sound data processing apparatus can be implemented in apparatus that is spatially separated from apparatus in which other components of the hearing assistive device are implemented, or as part of apparatus used to implement another component or components of the hearing assistive device (e.g., in apparatus used to implement sound data acquisition apparatus, sound production apparatus and/or sound replay apparatus).

For example, a hearing assistive device according to the invention can be implemented to produce sound from the replay sound data at the same volume as that at which the sound originally occurred, or at a louder or softer volume. Further, a hearing assistive device according to the invention can advantageously be implemented so that a user input apparatus of the hearing assistive device enables control of the volume of the sound replay to produce a sound replay having the same, louder or softer volume than that at which the sound originally occurred. For embodiments of a hearing assistive device according to the invention that include only a replay mode and an off mode, for instance, it may be adequate to implement the hearing assistive device so that the sound replay is produced at the same volume as that at which the sound originally occurred, since such a hearing assistive device will probably be used by people having little or no hearing impairment. For embodiments of a hearing assistive device according to the invention that include a current sound mode in addition to a replay mode (with or without an off mode), it is probably desirable either to implement the hearing assistive device so that the sound replay is produced at a louder volume than that at which the sound originally occurred, or so that a user input apparatus can be used to control the volume of the sound replay (which control should enable production of a sound replay at a louder volume than that at which the sound originally occurred), since many users of such a hearing assistive device will probably have a significant hearing impairment.

A hearing assistive device according to the invention can also be implemented to filter the replay sound data in a specified way to produce a sound replay having desired characteristics. For example, a hearing assistive device according to the invention can be implemented to filter out particular frequencies in the replay sound data, e.g., filter out frequencies above a specified level or below a specified level. As with the volume control discussed above, a hearing assistive device according to the invention can be implemented so that a user input apparatus of the hearing assistive device enables specification of a desired type of filtering of the replay sound data.

A hearing assistive device according to the invention can also be implemented to enable sound to be generated from the replay sound data at a different rate than that at which the sound actually occurred (i.e., the sound in replay mode can be speeded up or slowed down). This can be done using known techniques for speeding up or slowing down an audio display and/or removing periods of silence from an audio display, which techniques can be implemented in a hearing assistive device according to the invention by those skilled in the art. Processing the replay sound data in this way may be desirable, for example, to enable the user of the hearing assistive device to more quickly review the sound represented by the replay sound data, so as to reduce the time that the user's attention is diverted by such sound replay. Again, as with the volume control and filter control discussed above, a hearing assistive device according to the invention can be implemented so that a user input apparatus of the hearing assistive device enables control of the display rate for the sound replay.

Typically, a hearing assistive device according to the invention will be implemented so that user input apparatus (not illustrated in the drawings) controlled by the user of the hearing assistive device can be used to specify one or more control signals ("mode control signal(s)") that control the mode of operation of the hearing assistive device, i.e., operation in replay mode, current sound mode or off mode. (Herein, such a user input apparatus is sometimes referred to as a "mode selection device.") The mode selection device can be implemented using any of a variety of devices or mechanisms. For example, the mode selection device can be implemented using a pushbutton mechanism or a toggle switch. The invention can be implemented so that a single mode selection device can be used to control multiple hearing assistive devices according to the invention (e.g., a hearing assistive device worn on each ear of a wearer).

A hearing assistive device according to the invention can be implemented!so that a mode selection device can be operated in any of a variety of ways to select the mode of operation of the hearing assistive device. For example, a hearing assistive device according to the invention can be implemented to always operate in current sound mode or off mode unless, and as long as, a control signal is received from a mode selection device (e.g., the hearing assistive device operates in current sound mode or off mode unless a pushbutton mechanism is being depressed or a spring-loaded toggle switch is held in a position against the spring force, in which case the hearing assistive device operates in replay mode). Or, for example, a hearing assistive device according to the invention can be implemented to operate in current sound mode or off mode when the hearing assistive device is turned on, and to switch to and from replay mode each time that a control signal is subsequently received from a mode selection device (e.g., a pushbutton mechanism must be depressed to change from current sound mode or off mode to replay mode and vice versa, but need not continue to be depressed to remain in the selected mode; a toggle switch is moved back and forth between two positions to change from current sound mode or off mode to replay mode and vice versa). Or, for example, a hearing assistive device according to the invention can be implemented to operate so that each of the modes of operation can only be selected by specifying a particular control signal or set of control signals (e.g., each of replay mode, current sound mode and/or off mode can only be selected by depressing a pushbutton mechanism a corresponding number of times and/or depressing the pushbutton mechanism for a specified duration of time; each of replay mode, current sound mode and/or off mode is selected by moving a toggle switch to an appropriate position).

A hearing assistive device according to the invention can also be implemented so that a user input apparatus (not illustrated in the drawings) controlled by the user of the hearing assistive device can be used to specify one or more control signals ("replay duration control signal(s)") that establish the amount of replay time, e.g., that establish a duration of time prior to a current time from which sound can be replayed. (Herein, such a user input apparatus is sometimes referred to as a "replay duration specification device.") The replay duration control signal(s) can specify a particular amount of replay time by, for example, specifying the frequency of operation (i.e., switching) of a signal delay device used in implementation of the sound data accumulation device of a hearing assistive device according to the invention (see FIGS. 4-7 and associated description above) and can be input to, and stored on, a data storage device of the sound data accumulation device (if necessary or desirable). The replay duration specification device can be implemented using any of a variety of appropriate apparatus and can be operated in any of a variety of ways to specify the amount of replay time. For example, the replay duration specification device can be implemented by apparatus that is similar to apparatus currently used with some digital hearing aids to input new instructions to the digital processing unit of the hearing aid to effect particular processing (as discussed above with respect to FIG. 2) of the sound data. A hearing assistive device according to the invention can also be implemented so that data representing replay duration control signal(s) can be acquired by a replay duration specification device via a computer network (e.g., the Internet) or a telephone network (e.g., conventional telephone network, cellular telephone network).

In addition to the mode selection device and replay duration specification device discussed above, user input apparatus of a hearing assistive device according to the invention can enable other types of control of the operation of the hearing assistive device. For example, as discussed above, the user input apparatus of a hearing assistive device according to the invention can be implemented to enable control of the volume of the sound replay (the user input apparatus can also be implemented to enable control of the volume of the sound display in current sound mode), filtering of the replay sound data and/or the speed of the sound replay. A user input apparatus of a hearing assistive device according to the invention can also be implemented to enable other types of user control of the sound replay, such as fast-forward, pause and rewind.

User input apparatus of a hearing assistive device according to the invention, such as a mode selection device and/or replay duration specification device, can be implemented, in whole or in part, together with (e.g., integrally formed with, attached to, mounted on) one or more other components of the hearing assistive device (e.g., sound data acquisition apparatus, sound production apparatus, sound replay apparatus) in the same apparatus. User input apparatus of a hearing assistive device according to the invention can also be implemented, in whole or in part, in apparatus that is spatially separated from apparatus in which one or more other components of the hearing assistive device are implemented. Further, different components of user input apparatus of a hearing assistive device according to the invention (e.g., mode selection device and replay duration specification device) can be implemented in the same or spatially separated apparatus.

Some users of a hearing assistive device may desire to minimize the extent to which others are aware that a hearing assistive device is being used. For such users of a hearing assistive device, operating user input apparatus that is part of ear mounted hearing assistive apparatus may undesirably draw attention to the fact that a hearing assistive device is being used. Additionally, it can be awkward for a user of a hearing assistive device to interact with user input apparatus that is part of ear-mounted hearing assistive apparatus. A hearing assistive device according to the invention can advantageously be implemented so that user input apparatus of the hearing assistive device (e.g., mode selection device and/or replay duration specification device) is implemented in apparatus that is spatially separated from ear mounted hearing assistive apparatus (e.g., sound production apparatus of the hearing assistive device). For example, in some embodiments of the invention, user input apparatus of a hearing assistive device is implemented as part of a watch, as (or as part of) a handheld device, or as (or as part of) a device that can be carried in a pocket.

It is generally desirable to minimize the size and weight of ear-mounted hearing assistive apparatus. For example, reducing the size of ear-mounted hearing assistive apparatus can reduce the extent to which others can see the ear-mounted hearing assistive apparatus and be aware that a hearing assistive device is being worn. Additionally, reducing the size and weight of ear-mounted hearing assistive apparatus can tend to make wearing the ear mounted hearing assistive apparatus less uncomfortable.

A hearing assistive device according to the invention can be implemented so that part of the hearing assistive device is spatially separated from ear-mounted hearing assistive apparatus, thus enabling the ear-mounted hearing assistive apparatus to be made smaller and lighter, and/or the spatially separated parts of the hearing assistive device to be made larger and heavier, than would otherwise be the case. For example, as discussed above, user input apparatus of a hearing assistive device according to the invention, such as a mode selection device and/or a replay duration specification device, can advantageously be implemented in apparatus that is spatially separated from ear-mounted hearing assistive apparatus. However, other components of a hearing assistive device according to the invention can also be implemented in apparatus that is spatially separated from ear-mounted hearing assistive apparatus. In some embodiments of a hearing assistive device according to the invention, only the sound production apparatus and at least part of the sound data acquisition apparatus (e.g., a receiver for receiving signal(s) representing sensed sound that are transmitted by one or more transmitter(s), such as, for example, transmitter(s) not part of hearing assistive apparatus worn by a hearing assistive device wearer that are positioned away from the hearing assistive device wearer, or transmitter(s) associated with a microphone that is worn by a hearing assistive device wearer but that is spatially separated from the ear mounted hearing assistive apparatus) are implemented in ear-mounted hearing assistive apparatus of the hearing assistive device.

For instance, a hearing assistive device according to the invention can be implemented so that a microphone of the hearing assistive device is spatially separated from the ear-mounted hearing assistive apparatus of the hearing assistive device. Such an implementation can advantageously enable use of a larger microphone (which is typically more sensitive, i.e., better quality) than would otherwise be the case if the microphone was part of ear-mounted hearing assistive apparatus. Additionally, implementing the microphone to be spatially separated from the ear-mounted hearing assistive apparatus enables the microphone to be positioned at any location on the body of a hearing assistive device wearer other than that at which the ear-mounted hearing assistive apparatus is positioned, which may be desirable to provide acoustical characteristics that are different from those that would be produced when the microphone is part of the ear-mounted hearing assistive apparatus. Further, the microphone can be implemented as part of other apparatus worn by a hearing assistive device wearer; this may be desirable to make the presence of the microphone less obtrusive to the wearer and less noticeable to other people. For example, the microphone can be implemented as part of a lapel pin, a necklace, jewelry or other object worn by a hearing assistive device wearer. Implementing the microphone to be spatially separated from the ear-mounted hearing assistive apparatus can also enable the microphone to be positioned at a location that is not on the body of a hearing assistive device wearer. For example, the microphone can be positioned proximate to a source of sound that a hearing assistive device wearer desires to hear, such as a television speaker.

A hearing assistive device according to the invention can also be implemented so that part or all of the sound replay apparatus of the hearing assistive device is spatially separated from the ear mounted hearing assistive apparatus of the hearing assistive device. In such an implementation, the sound replay apparatus (or part of) can be positioned (worn) at any location on the body of a hearing assistive device wearer other than that at which the ear-mounted hearing assistive apparatus is positioned. The sound replay apparatus can also be implemented in apparatus that is not worn by the hearing assistive device wearer. For example, the sound replay apparatus can be implemented as part of a watch, a handheld device, or a device that can be carried in a pocket. As discussed above, when sound replay apparatus is provided as part of ear-mounted hearing assistive apparatus, the size and power consumption of the sound replay apparatus are of concern. Implementing a hearing assistive device according to the invention so that part or all of the sound replay apparatus of the hearing assistive device is spatially separated from the ear-mounted hearing assistive apparatus of the hearing assistive device can alleviate that concern to some degree. In particular, such an implementation can significantly reduce the size and weight of the ear-mounted hearing assistive apparatus by eliminating the sound replay apparatus from the ear-mounted hearing assistive apparatus and by reducing the power requirements (and thus the size of the power supply apparatus, e.g., battery) of the ear-mounted hearing assistive apparatus. In the same vein, such an implementation can enable the use of a larger sound replay apparatus and associated power supply than would otherwise be feasible, which can enable use of sound replay apparatus that can store more replay sound data, store replay sound data that produces a higher-fidelity sound display, and/or include enhanced processing capabilities (e.g., the capability of producing sound from the replay sound data at a different rate than that at which the sound actually occurred).

As discussed above, implementing a hearing assistive device according to the invention so that part of the hearing assistive device is spatially separated from ear-mounted hearing assistive apparatus can reduce the extent to which others are aware that a hearing assistive device wearer is wearing a hearing assistive device and can make wearing the hearing assistive device less uncomfortable. For both reasons, a prospective hearing assistive device wearer may be more inclined to wear such a hearing assistive device according to the invention than previous hearing aids, since the hearing assistive device according to the invention can be implemented with ear-mounted hearing assistive apparatus that is smaller than that of previous hearing aids. Such increased inclination to wear a hearing assistive device is particularly likely for prospective hearing assistive device wearers whose hearing is unimpaired or impaired relatively mildly, i.e., prospective hearing assistive device wearers who may be interested in particular in wearing a hearing assistive device in accordance with the embodiments of the invention illustrated in FIGS. 10A, 10B, 11A and 11B, discussed above. Thus, the embodiments of the invention illustrated in FIGS. 10A, 10B, 11A and 11B can advantageously be further implemented so that part of the hearing assistive device (as discussed above) is spatially separated from ear-mounted hearing assistive apparatus.

As discussed above, a hearing assistive device according to the invention can advantageously be implemented so that part of the hearing assistive device is spatially separated from ear-mounted hearing assistive apparatus of the hearing assistive device. More generally, a hearing assistive device according to the invention can be implemented so that part of the hearing assistive device is spatially separated from another part of the hearing assistive device (of which parts one or neither may be implemented in ear-mounted hearing assistive apparatus). For example, a microphone of a hearing assistive device according to the invention can be spatially separated from apparatus in which the sound replay apparatus of the hearing assistive device is implemented, both of which are spatially separated from ear-mounted hearing assistive apparatus (e.g., sound production apparatus and receiver) of the hearing assistive device. Such a hearing assistive device according to the invention may also include user input apparatus (e.g., mode selection device and/or replay duration specification device) that is spatially separated from each of the microphone, apparatus including the sound replay apparatus and the ear-mounted hearing assistive apparatus. The invention can encompass embodiments of a hearing assistive device that includes parts that are spatially separated from each other (e.g., sound data acquisition apparatus, such as a microphone, that is spatially separated from ear-mounted hearing assistive apparatus), but that does not include a replay capability. As discussed with respect to some particular embodiments of the invention above, implementing a hearing assistive device with parts that are spatially separated from each other can enable particular component(s) of the hearing assistive device to be made larger than would otherwise be feasible, include a power supply that is larger than would otherwise be feasible, and/or be made smaller than would otherwise be the case.

FIGS. 12A, 12B and 12C illustrate embodiments of a hearing assistive device according to the invention in which one or more parts of the hearing assistive device are spatially separated from ear-mounting hearing assistive apparatus of the hearing assistive device. In FIG. 12A, a part 1201 of the hearing assistive device that is spatially separated from ear-mounting hearing assistive apparatus 1202 of the hearing assistive device is adapted to be worn by a wearer of the hearing assistive device (as illustrated in FIG. 12A, attached to a shirt pocket of a wearer). In FIG. 12B, a part 1211 of the hearing assistive device that is spatially separated from ear-mounted hearing assistive apparatus 1212 of the hearing apparatus device is not adapted to be worn by a wearer of the hearing assistive device (as illustrated in FIG, 12B, held in a hand of the wearer). In FIG. 12C, two parts 1221 and 1222 of the hearing assistive device that are spatially separated from ear-mounting hearing assistive apparatus 1223 of the hearing assistive device are also spatially separate from each other, the part 1221 being adapted to be worn by a wearer of the hearing assitive device (as illustrated in FIG. 12C, attached to a shirt pocket of the wearer) and the part 1222 not (as illustrated in FIG. 12C, held in a hand of the wearer). Each of the parts of a hearing assistive device according to the embodiments of the invention illustrated in FIGS. 12A, 12B and 12C can be implemented in accordance with the description elsewhere herein.

When a hearing assistive device according to the invention is implemented so that part of the hearing assistive device is spatially separated from another part of the hearing assistive device, the hearing assistive device includes communication apparatus that enables communication, as necessary, between the spatially separated parts of the hearing assistive device. Such communication apparatus can advantageously be implemented using wireless communication apparatus and protocols; however, wired communication apparatus and protocols can also be used. (Herein, two components of hearing assistive apparatus are spatially separated if the only physical connection between the two components is a wire for enabling communication between the components.) The use of wireless communication can advantageously make the presence of the hearing assistive device less obtrusive to the user of a heating assistive device and less noticeable to other people. In general, any of a variety of wireless communication apparatus and protocols can be used to enable wireless communication between spatially separated parts of a hearing assistive device according to the invention. For example, the Bluetooth® protocol, which has been increasingly developed and used as a wireless communication protocol for small devices, can be used. The Bluetooth® protocol enables use of a power-efficient receiver, which can advantageously enable the use of a smaller power supply (e.g., battery) for the receiver than may otherwise be necessary or desirable; the use of a power-efficient receiver and corresponding small power supply can be particularly advantageous in car-mounted hearing assistive apparatus of a hearing assistive device according to the invention. IEEE 802 wireless communication protocols can also be used (e.g., the IEEE 802.11b protocol—also referred to as "WiFi"—or the more secure version(s) of that protocol that are being developed). Protocol(s) used by some movie theaters to broadcast movie soundtracks to patrons who have a hearinq assistive device can also be used to enable wireless communication between spatially separated parts of a hearing assistive device according to the invention.

In many embodiments of a hearing assistive device according to the invention, as described above, at least part of the hearing assistive device is implemented in ear-mounted hearing assistive apparatus, as a conventional hearing aid. However, the invention can also be implemented so that no part of a hearing assistive device according to the invention need be ear-mounted or otherwise worn by a user of the hearing assistive device. For example, in one embodiment of the invention, all parts of a hearing assistive device according to the invention are implemented in apparatus that can be carried by a user of the hearing assistive device. Such a portable hearing assistive device according to the invention can be implemented to enable operation in a replay mode, a current sound mode and an off mode, like hearing assistive devices according to other embodiments of the invention described above; however, since the sound production apparatus of the hearing assistive device is not ear-mounted, it is anticipated that such a portable hearing assistive device will often be implemented to only enable operation in a replay mode or an off mode. The hearing assistive device according to this embodiment of the invention can be further implemented to include user input apparatus (i.e., a mode selection device) that enables a user of the hearing assistive device to select a mode of operation of the hearing assistive device. When a user of a hearing assistive device according to this embodiment of the invention desires to listen to a sound replay, the user can position a sound production apparatus (e.g., speaker) of the hearing assistive device proximate to an ear of the user and use the user input apparatus (e.g., depress a pushbutton mechanism) to control the hearing assistive device to operate in replay mode to produce the sound replay. In general, a hearing assistive device according to this embodiment of the invention can include any of the functionality and/or characteristics of a hearing assistive device according to the invention as described above. A hearing assistive device according to this embodiment of the invention can be constructed, for example, as a single "ear muff" that can be held against the user's ear or as a headset that can be positioned on the user's head when the user desires to hear a sound replay.

In the embodiments of the invention described above, a hearing assistive device according to the invention enables replay of sound that occurs in the vicinity of the hearing assistive device. In other embodiments of the invention, other types of audio display apparatus can be implemented in accordance with the principles of the invention to enable replay of sound that occurs in the vicinity of the audio display apparatus (and, thus, in the vicinity of a user of the audio display apparatus). Such audio display apparatus can also be implemented to include other functionality (in addition to sound replay capability) that can be provided in a hearing assistive device according to the invention, as described above. Embodiments of the invention in which other types of audio display apparatus include above-described functionality of a hearing assistive device according to the invention can be implemented so that none of the audio display apparatus is ear mounted (like a portable hearing assistive device according to the embodiment of the invention discussed immediately above) or such embodiments of the invention can be implemented so that part or all (e.g., sound production apparatus) of the audio display apparatus is ear-mounted. Audio display apparatus according to such embodiments of the invention can include audio display capability (for convenience, sometimes referred to herein as "primary audio display capability") other than the capability of reproducing sound that occurs in the vicinity of the audio display apparatus. For example, in one embodiment of the invention, a radio (which can be implemented in a wide variety of apparatus, as is well known) can be constructed, in accordance with the description above, to include apparatus that enables replaying of sound that occurs in the vicinity of the radio. Or, for example, in another embodiment of the invention, an audio recording display device can be constructed, in accordance with the description above, to include apparatus that enables replaying of sound that occurs in the vicinity of the audio recording display device. The audio recording display device can play audio recordings recorded in any format (e.g., MP3, WMA) and on any medium (e.g., CD). Like a portable hearing assistive device according to the embodiment of the invention discussed immediately above, a radio or audio recording display device including hearing assistive apparatus in accordance with the invention can be constructed, for example, as a single ear muff that can be held against the user's ear or as a headset that can be worn on the user's head. The principles of the invention can also be used to construct a tape recorder having enhanced capabilities for replaying sound recorded by the tape recorder. In particular, the invention can be used to enable continued recording of sound occurring in the vicinity of the tape recorder during replay of sound previously recorded by the tape recorder. As indicated above, in further particular embodiments of each of the foregoing exemplary embodiments of audio display apparatus including sound replay capability in accordance with the invention, the audio display apparatus can be constructed to include other above-described functionality of a hearing assistive device according to the invention.

Aspects of the invention can be implemented, in whole or in part, by one or more computer programs and/or data structures, or as part of one or more computer programs and/or data structure(s), including instruction(s) and/or data for accomplishing the functions of the invention. For example, in addition to the discussion above of examples of such implementation of the invention, such computer program(s) and/or data structure(s) can include instruction(s) and/or data, depending on the embodiment of the invention, for effecting volume control of the sound replay, filtering (e.g., frequency filtering) the replay sound data, changing the speed of the sound replay and/or effecting other types of control of the operation of a hearing assistive device according to the invention as discussed above. Those skilled in the art can readily implement aspects of the invention using one or more computer program(s) and/or data structure(s) in view of the description herein. Further, those skilled in the art can readily appreciate how to implement such computer program(s) and/or data structure(s) to enable execution using a variety of computational devices and/or a variety of computational platforms.

Various embodiments of the invention have been described. The descriptions are intended to be illustrative, not limitative. Thus, it will be apparent to one skilled in the art that certain modifications may be made to the invention as described herein without departing from the scope of the claims set out below.

I claim:

1. A hearing assistive device, comprising:

sound data acquisition apparatus adapted to acquire current sound data representing sound that occurs in the vicinity of the hearing assistive device;

sound production apparatus adapted to produce sound in accordance with sound data acquired by the sound data acquisition apparatus, the sound production apparatus adapted to be mounted on, in, or proximate to an ear of a wearer of the hearing assistive device;

sound replay apparatus, the sound replay apparatus comprising:

a sound data accumulation device for accumulating replay sound data representing sound occurring during a replay time; and a sound data selection device for controlling the hearing assistive device to operate in one of multiple possible modes of operation of the hearing assistive device, the multiple possible modes of operation comprising a replay mode in which the replay sound data is transmitted to the sound production apparatus for use in producing sound and an off mode in which all sound data is inhibited from being transmitted to the sound production apparatus, wherein the sound data acquisition apparatus acquires current sound data during operation of the hearing assistive device in each of the multiple possible modes of operation, and wherein:

at least part of the sound data acquisition apparatus and/or the sound replay apparatus is spatially separated from the sound production apparatus, the hearing assistive device further comprising:

communication apparatus that enables communication between the sound production apparatus and the part of the sound data acquisition apparatus and/or the sound replay apparatus that is spatially separated from the sound production apparatus.

2. A hearing assistive device as in claim 1, wherein at least part of the sound replay apparatus is spatially separated from the sound production apparatus.

3. A hearing assistive device as in claim 2, wherein the part of the sound replay apparatus that is spatially separated from the sound production apparatus is adapted to be worn by the wearer.

4. A hearing assistive device as in claim 2, wherein the part of the sound replay apparatus that is spatially separated from the sound production apparatus is not adapted to be worn by the wearer.

5. A hearing assistive device as in claim 1, wherein at least part of the sound data acquisition apparatus is spatially separated from the sound production apparatus.

6. A hearing assistive device as in claim 5, wherein the sound data acquisition apparatus comprises a microphone that is spatially separated from the sound production apparatus.

7. A hearing assistive device as in claim 6, wherein the microphone is adapted to be worn by the wearer.

8. A hearing assistive device as in claim 6, wherein the microphone is part of other apparatus that is adapted to be worn by the wearer.

9. A hearing assistive dev.ice as in claim 1, further comprising user input apparatus that is spatially separated from the sound production apparatus.

10. A hearing assistive device as in claim 9, wherein the user input apparatus comprises a mode selection device for enabling the wearer of the hearing assistive device to specify a mode of operation of the hearing assistive device.

11. A hearing assistive device as in claim 10, wherein the user input apparatus comprises a replay duration specification device for enabling the wearer of the hearing assistive device to specify a replay time.

12. A hearing assistive device as in claim 9, wherein the user input apparatus comprises a replay duration specification device for enabling the wearer of the hearing assistive device to specify a replay time.

13. A hearing assistive device as in claim 9, wherein at least part of the sound replay apparatus is spatially separated from the sound production apparatus.

14. A hearing assistive device as in claim 13, wherein at least part of the sound data acquisition apparatus is spatially separated from the sound production apparatus.

15. A hearing assistive device as in claim 14, wherein the part of the sound data acquisition apparatus that is spatially separated from the sound production apparatus is also spatially separated from the user input apparatus and the part of the sound replay apparatus that is spatially separated from the sound production apparatus.

16. A hearing assistive device as in claim 9, wherein at least part of the sound data acquisition apparatus is spatially separated from the sound production apparatus.

17. A hearing assistive device as in claim 16, wherein the part of the sound data acquisition apparatus that is spatially separated from the sound production apparatus is also spatially separated from the user input apparatus.

18. A hearing assistive device as in claim 1, wherein the communication apparatus comprises wireless communication apparatus.

19. A hearing assistive device as in claim 18, wherein the wireless communication apparatus operates in accordance with the Bluetooth® protocol.

20. A hearing assistive device as in claim 18, wherein the wireless communication apparatus operates in accordance with an IEEE 802 wireless communication protocol.

21. A hearing assistive device as in claim 18, wherein the wireless communication apparatus operates in accordance with a wireless communication protocol used to broadcast a movie soundtrack for reception by a hearing aid worn by a patron in a movie theater.

22. A hearing assistive device as in claim 1, wherein the sound data acquisition apparatus comprises a receiver for receiving a signal representing sensed sound transmitted by a transmitter.

23. A hearing assistive device as in claim 22, wherein the transmitter is positioned at a location that is not proximate to an ear of the wearer of the hearing assistive device.

24. A hearing assistive device as in claim 1, wherein the multiple possible modes of operation comprise a current sound mode in which the current sound data is transmitted to the sound production apparatus for use in producing sound.

25. A hearing assistive device that can i) acquire current sound data representing sound that occurs in the vicinity of the hearing assistive device, ii) produce sound in accordance with sound data, iii) accumulate replay sound data representing sound occurring during a replay time, iv) operate in one of multiple possible modes of operation, the multiple possible modes of operation comprising a replay mode in which the replay sound data is used in producing sound and an off mode in which all sound data is inhibited from being used to produce sound, wherein current sound data is acquired during operation of the hearing assistive device in each of the multiple possible modes of operation, and v) enable communication between sound production apparatus adapted to be mounted on, in, or proximate to an ear of a wearer of the hearing assistive device and a part of sound data acquisition apparatus and/or sound replay apparatus that is spatially separated from the sound production apparatus.

26. A method for assisting hearing, comprising the steps of:

acquiring current sound data representing sound that occurs in the vicinity of a hearing assistive device;

producing sound in accordance with sound data;

accumulating replay sound data representing sound occurring during a replay time;

controlling the hearing assistive device to operate in one of multiple possible modes of operation of the hearing assistive device, the multiple possible modes of operation comprising a replay mode in which the replay sound data is used in producing sound and an off mode in which all sound data is inhibited from being used in producing sound, wherein current sound data is acguired during operation of the hearing assistive device in each of the multiple possible modes of operation; and communicating between sound production apparatus adapted to be mounted on, in, or proximate to an ear of a wearer of the hearing assistive device and a part of sound data acquisition apparatus and/or sound replay apparatus that is spatially separated from the sound production apparatus.

27. A hearing assistive device, comprising:

sound data acquisition apparatus adapted to acquire current sound data representing sound that occurs in the vicinity of the hearing assistive device;

sound production apparatus adapted to produce sound in accordance with sound data acquired by the sound data acquisition apparatus, the sound production apparatus adapted to be mounted on, in, or proximate to an ear of a wearer of the hearing assistive device;

sound replay apparatus, the sound replay apparatus comprising:

a sound data accumulation device for accumulating replay sound data representing sound occurring during a replay time; and a sound data selection device for controlling the hearing assistive device to operate in one of multiple possible modes of operation of the hearing assistive device, the multiple possible modes of operation comprising a replay mode in which the replay sound data is transmitted to the sound production apparatus for use in producing sound and an off mode in which all sound data is inhibited from being transmitted to the sound production apparatus, wherein the sound data acquisition apparatus acquires current sound data during operation of the hearing assistive device in each of the multiple possible modes of operation;

user input apparatus for enabling the wearer of the hearing assistive device to control operation of the hearing assistive device, wherein the user input apparatus is spatially separated from the sound production apparatus; and communication apparatus that enables communication between spatially separated parts of the hearing assistive device.

28. A hearing assistive device as in claim 27, wherein the user input apparatus comprises a mode selection device for enabling the wearer of the hearing assistive device to specify a mode of operation of the hearing assistive device.

29. A hearing assistive device as in claim 28, wherein the user input apparatus further comprises a replay duration specification device for enabling the wearer of the hearing assistive device to specify a replay time.

30. A hearing assistive device as in claim 27, wherein the user input apparatus comprises a replay duration specification device for enabling the wearer of the hearing assistive device to specify a replay time.

31. A hearing assistive device as in claim 27, wherein the user input apparatus is part of a watch.

32. A hearing assistive device as in claim 27, wherein the user input apparatus comprises a handheld device.

33. A hearing assistive device as in claim 27, wherein the communication apparatus comprises wireless communication apparatus.

34. A hearing assistive device as in claim 33, wherein the wireless communication apparatus operates in accordance with the Bluetooth® protocol.

35. A hearing assistive device as in claim 33, wherein the wireless communication apparatus operates in accordance with an IEEE 802 wireless communication protocol.

36. A hearing assistive device as in claim 33, wherein the wireless communication apparatus operates in accordance with a wireless communication protocol used to broadcast a movie soundtrack for reception by a hearing aid worn by a patron in a movie theater.

37. A hearing assistive device as in claim 27, wherein the multiple possible modes of operation comprise a current sound mode in which the current sound data is transmitted to the sound, production apparatus for use in producing sound.

38. A hearing assistive device that can i) acquire current sound data representing sound that occurs in the vicinity of the hearing assistive device, ii) produce sound in accordance with sound data, iii) accumulate replay sound data representing sound occurring during a replay time, iv) operate in one of multiple possible modes of operation, the multiple possible modes of operation comprising a replay mode in which the replay sound data is used in producing sound and an off mode in which all sound data is inhibited from being used to produce sound, wherein current sound data is acquired during operation of the hearing assistive device in each of the multiple possible modes of operation, and v) enable communication between sound production apparatus adapted to be mounted on, in, or proximate to an ear of a wearer of the hearing assistive device and user input apparatus that is spatially separated from the sound production apparatus.

39. A method for assisting hearing, comprising the steps of:

acquiring current sound data representing sound that occurs in the vicinity of a hearing assistive device;

producing sound in accordance with sound data;

accumulating replay sound data representing sound occurring during a replay time;

controlling the hearing assistive device to operate in one of multiple possible modes of operation of the hearing assistive device, the multiple possible modes of operation comprising a replay mode in which the replay sound data is used in producing sound and an off mode in which all sound data is inhibited from being used in producing sound, wherein current sound data is acguired during operation of the hearing assistive device in each of the multiple possible modes of operation; and communicating between sound production apparatus adapted to be mounted on, in, or proximate to an ear of a wearer of the hearing assistive device and user input apparatus that is spatially separated from the sound production apparatus.

* * * * *